US011780231B2

(12) United States Patent
Kosaka et al.

(10) Patent No.: US 11,780,231 B2
(45) Date of Patent: Oct. 10, 2023

(54) EJECTION APPARATUS AND WIPING METHOD

(71) Applicant: CANON KABUSHIKI KAISHA, Tokyo (JP)

(72) Inventors: Kei Kosaka, Tokyo (JP); Hirokazu Yoshikawa, Kanagawa (JP); Toshiyuki Chikuma, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 72 days.

(21) Appl. No.: 17/586,462

(22) Filed: Jan. 27, 2022

(65) Prior Publication Data

US 2022/0250387 A1 Aug. 11, 2022

(30) Foreign Application Priority Data

Feb. 9, 2021 (JP) ..... 2021-019162

(51) Int. Cl.
*B41J 2/165* (2006.01)
*B41J 2/21* (2006.01)

(52) U.S. Cl.
CPC ..... *B41J 2/16547* (2013.01); *B41J 2/16538* (2013.01); *B41J 2/16579* (2013.01); *B41J 2/2103* (2013.01); *B41J 2002/16564* (2013.01)

(58) Field of Classification Search
CPC ..... B41J 2/16547; B41J 2/16538; B41J 2/16579; B41J 2/16535
See application file for complete search history.

(56) References Cited

U.S. PATENT DOCUMENTS

2010/0033531 A1 2/2010 Suzuki et al.
2014/0253633 A1 9/2014 Kobayashi et al.
2021/0031530 A1* 2/2021 Shimada ..... B41J 2/16517

FOREIGN PATENT DOCUMENTS

JP 6969274 B2 * 11/2021 ..... B41J 2/16508

* cited by examiner

*Primary Examiner* — Sharon Polk
(74) *Attorney, Agent, or Firm* — Canon U.S.A., Inc. I.P. Division

(57) ABSTRACT

An ejection apparatus includes an ejection head, and a recessed portion, a wiper, an installation unit, and a moving unit configured to move the blade and the ejection head relative to each other, wherein the wiper performs a wiping operation for wiping the ejection head to wipe the ejection port after wiping the recessed portion, and wherein in the wiping operation, a first wiping operation is performed in a state where the ejection port surface and the installation unit on which the wiper is installed are at a first distance in a direction perpendicular to the ejection port surface, and a second wiping operation is performed in a state where the ejection port surface and the installation unit on which the wiper is installed are at a second distance in the direction perpendicular to the ejection port surface, the second distance being larger than the first distance.

17 Claims, 21 Drawing Sheets

FIG.8

| | | CR STOP POSITION [slit] | CONTACT STATE BETWEEN CAP AND HEAD |
|---|---|---|---|
| RECOVERY | CAP CLOSE POSITION | 0 | CONTACT STATE |
| | WIPE TRIGGER POSITION | 50 | CONTACT STATE |
| | WIPING PRELIMINARY EJECTION POSITION | 100 | NON-CONTACT STATE |
| | CAP OPEN POSITION | 150 | NON-CONTACT STATE |
| | WIPE TRIGGER RELEASE POSITION | 700 | NON-CONTACT STATE |
| CARRIAGE HEIGHT ADJUSTMENT | READY-TO-ASCEND POSITION | 200 | NON-CONTACT STATE |
| | DESCENDING POSITION | 300 | NON-CONTACT STATE |
| | ASCENDING POSITION | 400 | NON-CONTACT STATE |
| | READY-TO-DESCEND POSITION | 500 | NON-CONTACT STATE |

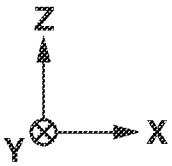
FIG.9C
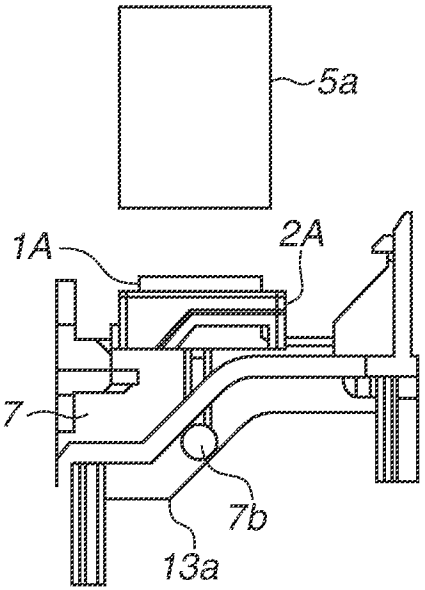
FIG.9B
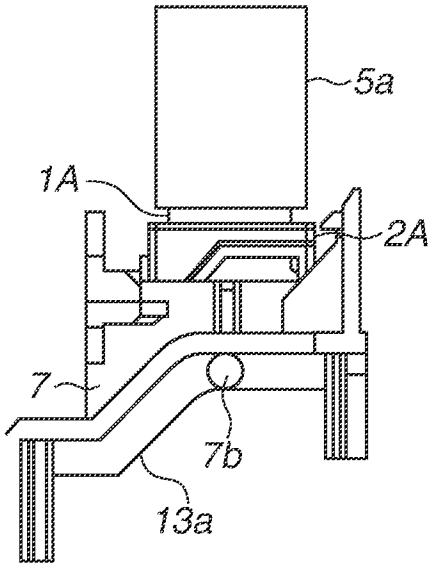
FIG.9A
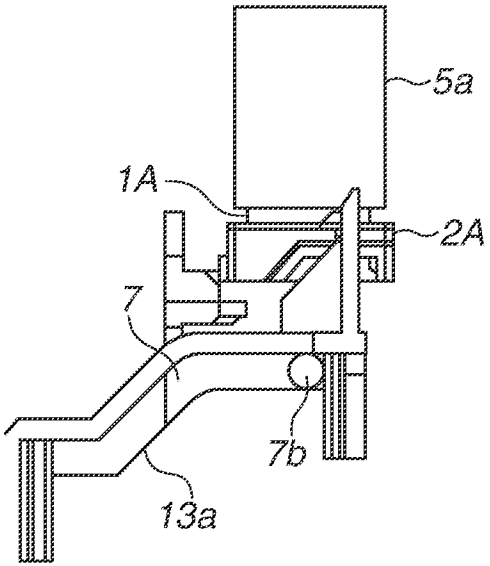

FIG.13

| | CARRIAGE HEIGHT | WIPER INTRUSION AMOUNT [mm] | WIPING SPEED [mm/s] | REPETITIVE NUMBER M | REPETITIVE NUMBER N |
|---|---|---|---|---|---|
| WIPING A1 | NORMAL Position | 1.5 | 110 | 1 | 1 |
| WIPING A2 | NORMAL Position | 1.5 | 110 | 4 | 1 |
| WIPING B | Wide Position | 0.7 | 110 | 4 | 3 |

FIG.17

| | WIPPING A1, A2 (INTRUSION AMOUNT IS LARGE) | WIPPING B (INTRUSION AMOUNT IS SMALL) |
|---|---|---|
| INK REMOVABILITY OF TAB SURFACE/ NOZZLE SURFACE | ✓: EASILY REMOVED | △: HARDLY REMOVED |
| INK ADHERENCE TO TAB SURFACE | △: EASILY ADHERE | ✓: HARDLY ADHERE |
| INK REMOVABILITY OF RECESSED PORTION | △: HARDLY REMOVED | ✓: EASILY REMOVED |

EJECTION APPARATUS AND WIPING METHOD

BACKGROUND OF THE DISCLOSURE

Field of the Disclosure

The present disclosure relates to an ejection apparatus and a wiping method.

Description of the Related Art

United States Patent Application Publication No. 2010/0033531 discusses a recording apparatus having a configuration in which an ejection port surface is wiped with a blade to recover an ejection state of a recording head.

However, some recording heads have a configuration in which a recessed portion is formed on an ejection port side near a surface on which ejection ports are formed. If the ejection port surface is wiped in a state where ink is accumulated in the recessed portion, the ink is drawn out of the recessed portion and remains as ink droplets on the ejection port surface, which may cause an ejection failure. However, if wiping conditions are weakened to prevent the ink droplets from being drawn out, the ejection port surface may not be fully cleaned.

SUMMARY OF THE INVENTION

The present disclosure has been made in view of the above-described issue and aspects generally are related to preventing an ejection failure from occurring after a wiping operation, while an ejection port surface is fully cleaned.

According to an aspect of the present disclosure, an ejection apparatus includes an ejection head including an ejection port surface on which an ejection port configured to eject liquid is disposed, and a recessed portion that is formed at a position different from the ejection port surface on an ejection port surface side and is recessed further than at least the ejection port surface, a wiper configured to wipe the ejection port surface, an installation unit on which the wiper is installed, and a moving unit configured to cause the wiper and the ejection head to move relative to each other, by moving at least one of the wiper and the ejection head, to cause the wiper to move in a first direction along the ejection port surface with respect to the ejection head, wherein the wiper performs a wiping operation for wiping the ejection head to wipe the ejection port after wiping the recessed portion, and wherein in the wiping operation, a first wiping operation is performed in a state where the ejection port surface and the installation unit are at a first distance in a direction perpendicular to the ejection port surface, and a second wiping operation is performed in a state where the ejection port surface and the installation unit are at a second distance in the direction perpendicular to the ejection port surface, the second distance being greater than the first distance.

Further features of the present disclosure will become apparent from the following description of exemplary embodiments with reference to the attached drawings.

BRIEF DESCRIPTION OF THE DRAWINGS

FIG. 8 is a table illustrating a list of carriage stop positions according to the present exemplary embodiment.

FIGS. 9A to 9C are front views each illustrating a positional relationship between a wiper and the recording head according to the exemplary embodiment.

FIG. 13 is a table illustrating wiping conditions according to the exemplary embodiment.

FIG. 17 is a table illustrating a list of recovery performances in wiping A1, wiping A2, and wiping B according to the exemplary embodiment.

DESCRIPTION OF THE EMBODIMENTS

Figure 1:
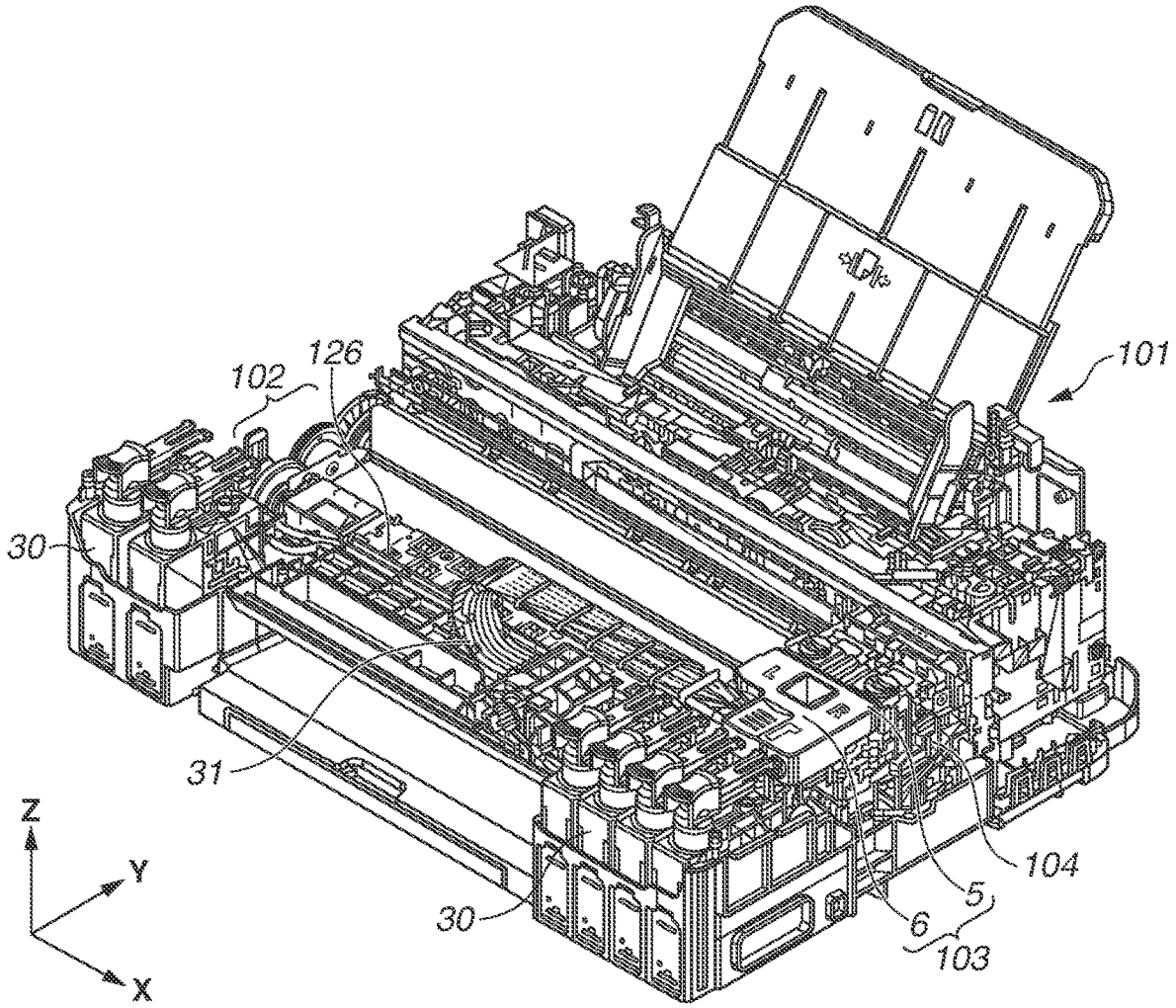
FIG. 1 is a perspective view illustrating an inkjet recording apparatus according to an exemplary embodiment of the present disclosure.

Exemplary embodiments of the present disclosure will be described in detail below with reference to the drawings. The same or corresponding portions are denoted by the same reference numerals throughout the drawings.

FIG. 1 is a perspective view illustrating an internal configuration of an inkjet recording apparatus 100 according to an exemplary embodiment of the present disclosure.

As illustrated in FIG. 1, the inkjet recording apparatus (hereinafter, also referred to simply as a recording apparatus) 100 includes a feeding unit 101, a conveyance unit 102, a recording mechanism unit 103, and a recovery mechanism unit 104. The feeding unit 101 supplies a recording medium P, such as a recording sheet, into a main body of the inkjet recording apparatus 100. The conveyance unit 102 conveys the recording medium P supplied from the feeding unit 101 in a negative Y-direction. The recording mechanism unit 103 includes a carriage 6 and a recording head 5 mounted on the carriage 6. The recording mechanism unit 103 operates based on image information and records an image on the recording medium P. The recovery mechanism unit 104 is configured to maintain or recover an ink ejection performance of the recording head 5.

Liquid containers 30 each containing ink are connected to the recording head 5 with a supply tube 31, and the liquid containers 30 supply ink to the recording head 5 through the supply tube 31.

Recording media P stacked on the feeding unit 101 are separated one by one and the separated recording medium P is delivered by a paper feed roller driven by a paper feed motor 4013 (see FIG. 4), to be supplied to the conveyance unit 102. The recording medium P supplied to the conveyance unit 102 is nipped between a conveyance roller (not illustrated) and a pinch roller (not illustrated) that are driven by the paper feed motor 4013 and is conveyed onto a platen 126. The recording medium P conveyed onto the platen 126 is subjected to recording by the recording mechanism unit 103. The carriage 6 that has the recording head 5 mounted thereon and is configured to move in a main scanning direction (X-direction) is driven based on image information, and recording is performed by causing ink to be ejected from ejection ports of the recording head 5. The recording medium P on which recording has been performed is nipped between a discharge roller and a spur that are driven synchronously with the conveyance roller, to be discharged to the outside of the apparatus body.

The recording mechanism unit 103 includes the carriage 6 configured to reciprocate in the main scanning direction (X-direction) and the recording head 5 mounted on the carriage 6. The carriage 6 is guided and supported such that the carriage 6 can reciprocate along a guide rail installed on the apparatus body. The reciprocating movement of the carriage 6 is driven by a carriage motor 4011 (see FIG. 4) via a carriage belt 124 (see FIG. 2). The reciprocating movement of the carriage 6 is controlled by detecting the position and speed of the carriage 6 using an encoder scale that is suspended between the apparatus body and an encoder sensor mounted on the carriage 6. An image corresponding to one scan is recorded by a recording operation of the recording head 5 in synchronization with the movement (scanning) of the carriage 6. Recording of the image on the entire recording medium P is performed by repeatedly performing an operation in which the recording medium P is conveyed (sub-scanning) at a predetermined pitch after the image corresponding to one scan is recorded. The height of the carriage 6 in a Z-direction can be changed. The carriage 6 is moved in the Z-direction by driving the paper feed motor 4013 and the carriage motor 4011. A lever (not illustrated) is connected to the carriage 6 by the paper feed motor 4013, and the carriage motor 4011 is driven in the connected state, whereby the carriage 6 is moved in the Z-direction.

Figure 6:
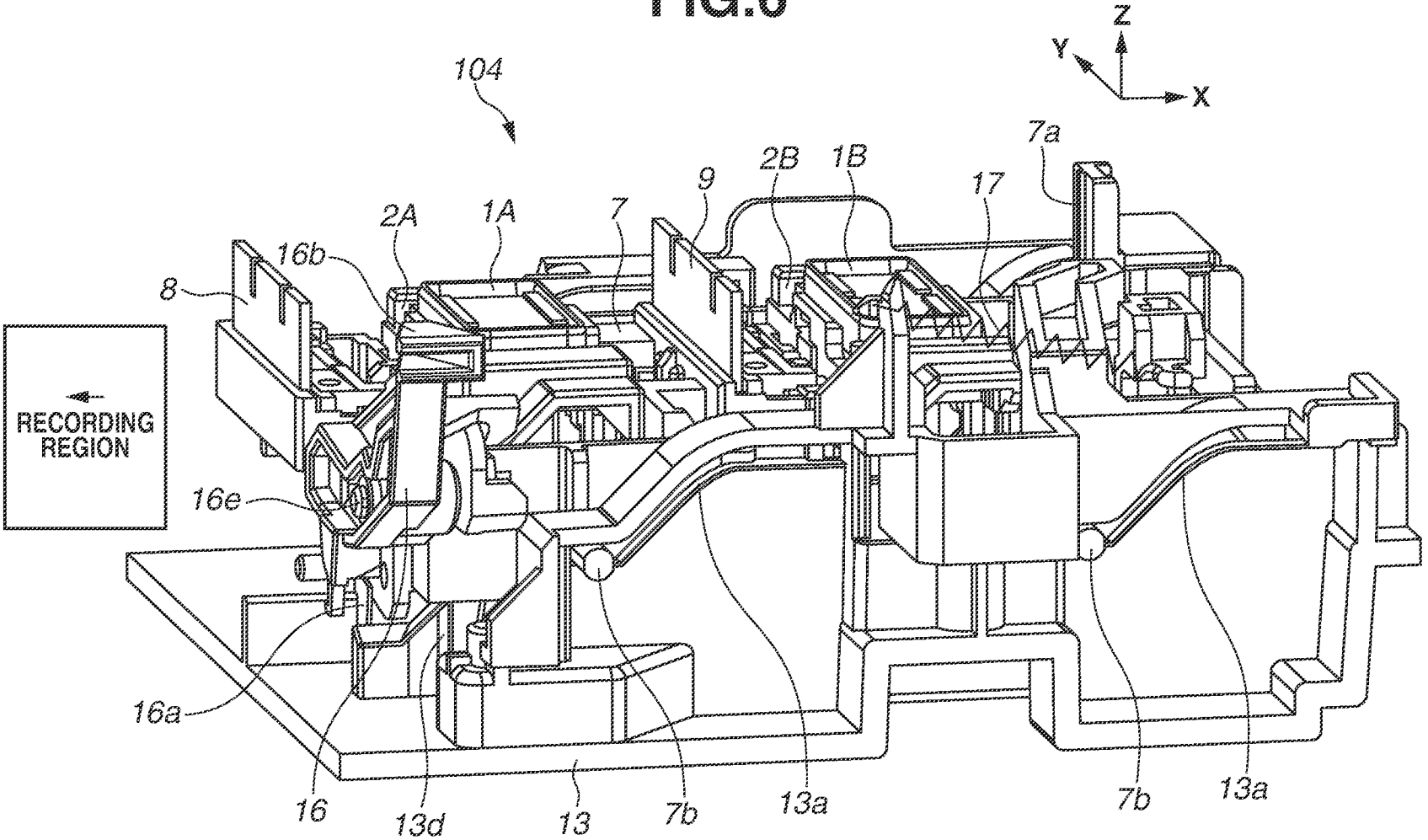
FIG. 6 is a perspective view illustrating a recovery mechanism portion according to the exemplary embodiment.

The recovery mechanism unit 104 is provided to maintain or recover quality of an image to be recorded in a normal state by, for example, unclogging the ejection ports of the recording head 5. The recovery mechanism unit 104 includes a wiping mechanism for wiping an ejection port surface, a capping mechanism for covering the ejection port surface, and a suction mechanism including a suction pump for sucking ink from each of the ejection ports. As illustrated in FIG. 6, the recovery mechanism unit 104 according to the present exemplary embodiment includes a slider 7 that is configured to be movable within a predetermined range by following the movement of the carriage 6 when the carriage 6 moves toward the recovery mechanism unit 104. The slider 7 is provided with wipers 8 and 9 of the wiping mechanism and caps 1A and 1B (hereinafter, caps 1A and 1B is also referred to simply as a cap 1) of the capping mechanism. In other words, the slider 7 is an installation unit on which the wipers 8 and 9 and the caps 1A and 1B are installed.

Figure 2:
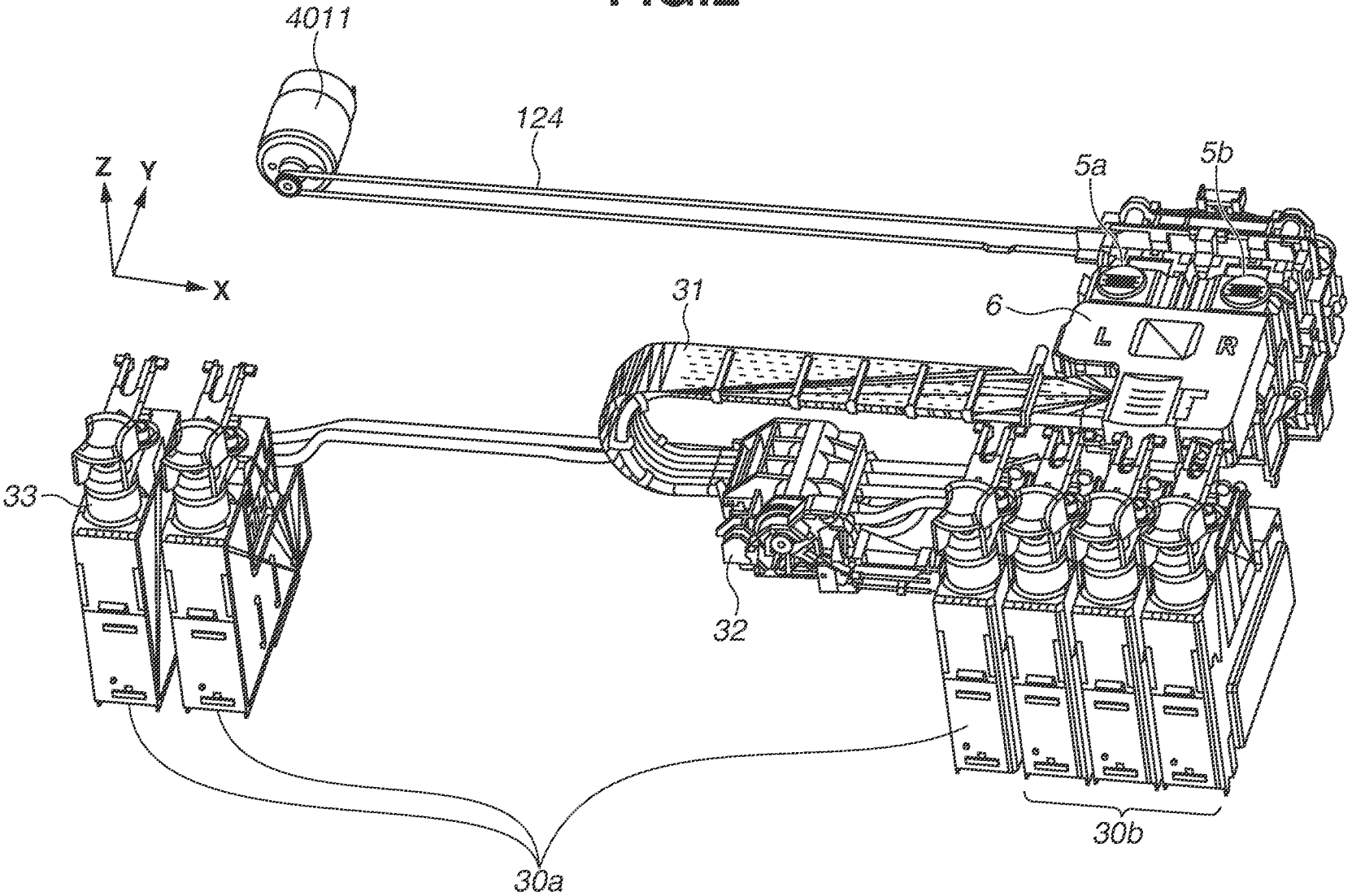
FIG. 2 is a perspective view illustrating a supply mechanism according to the exemplary embodiment.

FIG. 2 is a perspective view illustrating an ink supply mechanism according to the present exemplary embodiment. Special ink (black, red, and gray) liquid containers 30*a* among the liquid containers 30 are each connected to a recording head 5*a* with the supply tube 31. Color ink (cyan, magenta, and yellow) liquid containers 30*b* among the liquid containers 30 are each connected to a recording head 5*b* with the supply tube 31. The supply tube 31 can be closed by manually moving a tube valve 32.

Figure 3:
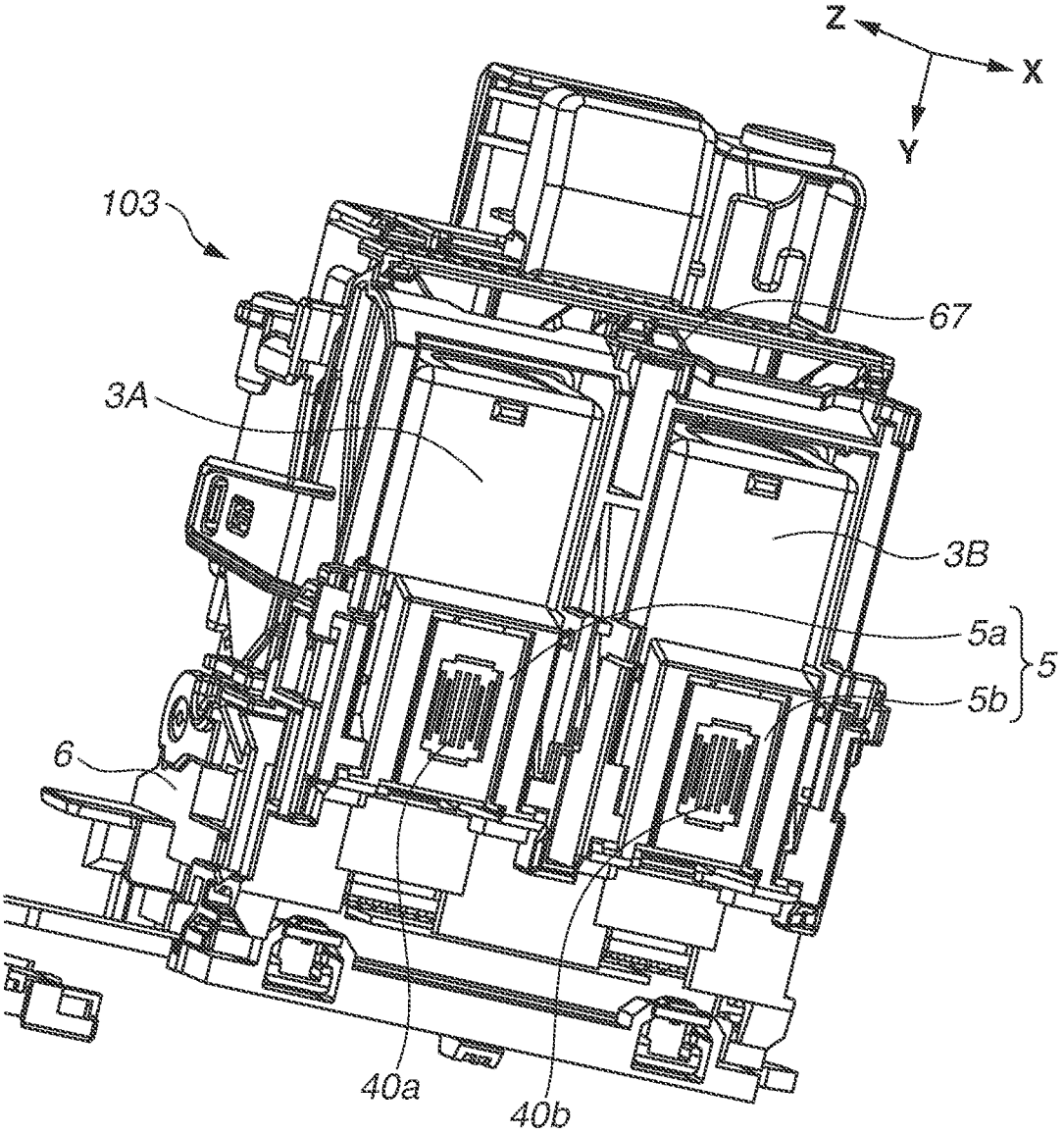
FIG. 3 is a perspective view illustrating a recording head according to the exemplary embodiment.

FIG. 3 is a perspective view illustrating the recording mechanism unit 103 according to the present exemplary embodiment. As illustrated in FIG. 3, the two recording heads 5*a* and 5*b* (hereinafter, also referred to simply as recording head 5) that eject a plurality of types of ink are detachably mounted on the carriage 6. Ejection port rows, in which ejection ports for ejecting special ink of three colors of black, red, and gray are arranged in a Y-direction, are formed on an ejection port surface 40*a* of the recording head 5*a* in the X-direction. Ejection port rows, in which ejection ports for ejecting ink of three colors of cyan, magenta, and yellow are arranged in the Y-direction, are formed on an ejection port surface 40*b* of the recording head 5*b* in the X-direction. Each of the ejection ports is provided with a recording element for ejecting ink. The ejection port surfaces 40*a* and 40*b* are also referred to simply as an ejection port surface 40.

The recording head (ejection head) 5 according to the present exemplary embodiment is an inkjet recording head that ejects ink using thermal energy. Each of the recording elements is an electrothermal conversion member for generating thermal energy.

Specifically, thermal energy is generated in response to a pulse signal applied to the electrothermal conversion member, and the generated thermal energy causes film boiling in ink liquid. Then, ink is ejected from each ejection port by bubbling pressure of film boiling, whereby recording image is performed.

The configuration of each ejection port row of the recording head 5 is not limited to the above describe configuration. For example, a single recording head may be provided with an ejection port row for ejecting a single color of ink. Instead of using the configuration for supplying ink from the liquid containers 30 to the recording head 5, a so-called cartridge system in which a liquid container and a recording head are integrally mounted on a carriage may be used. A recording apparatus having a configuration in which the recording head for ejecting a single color of ink is mounted may also be used. While the present exemplary embodiment illustrates an example of a recording apparatus on which a recording head for performing image recording is mounted, any ejection apparatus on which an ejection head for ejecting liquid is mounted may be used. The type of liquid to be ejected is not limited to ink, and liquid other than liquid for recording an image may also be used. Reaction liquid for fixing, for example, liquid resin or ink onto a recording medium may also be used.

Figure 4:
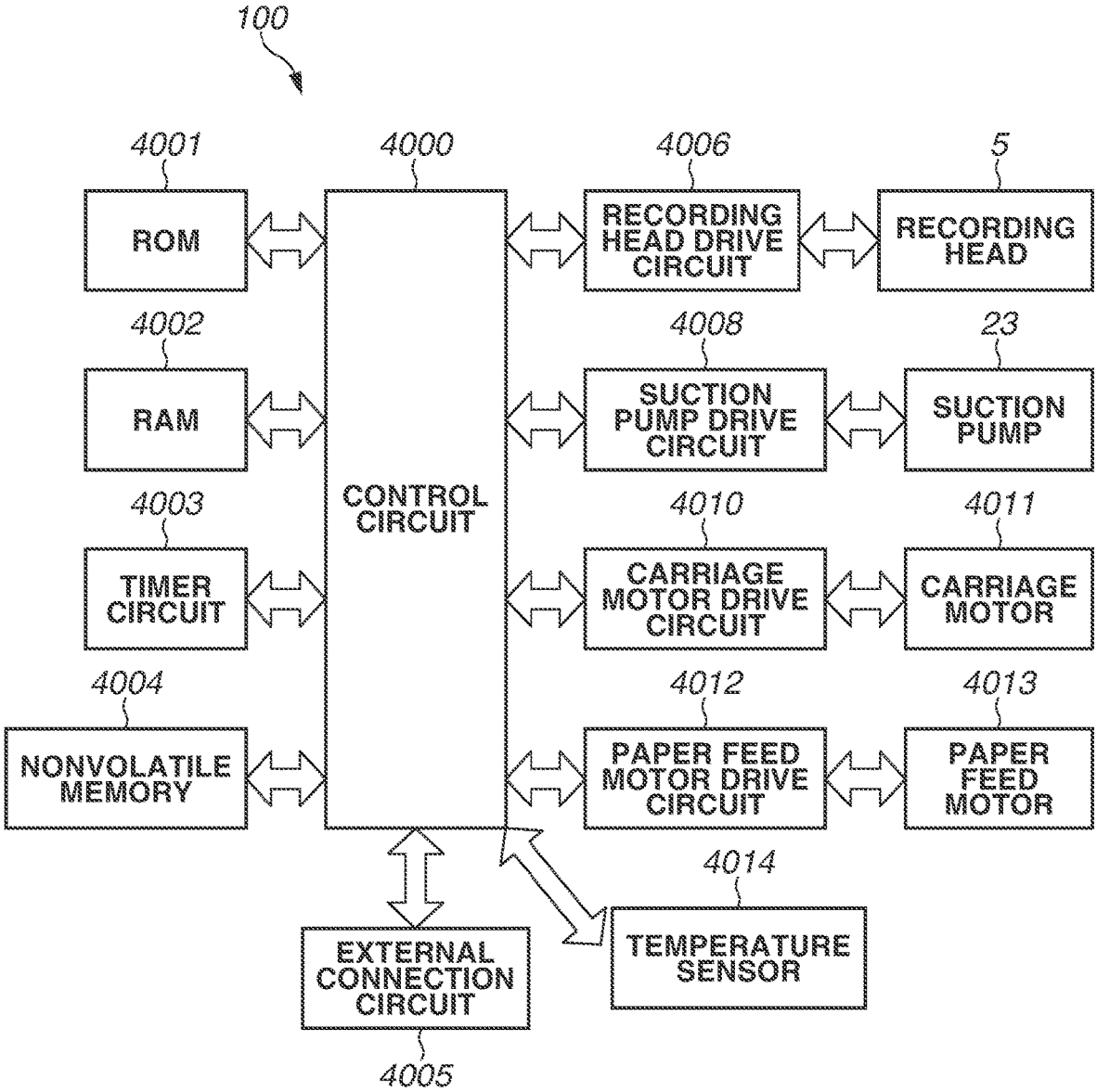
FIG. 4 is a block diagram illustrating a control configuration according to the exemplary embodiment.

FIG. 4 is a block diagram illustrating the inkjet recording apparatus 100 according to the present exemplary embodiment. A read-only memory (ROM) 4001 stores control programs to be executed and setting values for control processing. A random access memory (RAM) 4002 is configured to load control programs upon execution of the control programs, store print data and control commands, and store control variables for each control processing. A timer circuit 4003 is a circuit configured to acquire the current time, or a circuit configured to measure an elapsed time. A nonvolatile memory 4004 is a storage unit configured to store parameters stored in control processing even in a state where the main body of the inkjet recording apparatus 100 is powered off. In the present exemplary embodiment, the time at which an elapsed time is calculated is written and read. A control circuit 4000 executes control programs stored in the ROM 4001, or control programs loaded into the RAM 4002. A sequence described in the present exemplary embodiment is a part of a sequence to be executed by the above-described control programs.

An external connection circuit 4005 is an interface for establishing a communication between the inkjet recording apparatus 100 and an external host apparatus by wired communication or wireless communication. The external connection circuit 4005 is a circuit configured to enable the control circuit 4000 to treat information transmitted via the communication as control signals. Image data to be printed is input from the external host apparatus via the external connection circuit 4005. The current time may be acquired from the external host apparatus via the external connection circuit 4005.

A temperature sensor 4014 is a sensor that measures a temperature near the ejection ports. The temperature sensors 4014 is disposed for each of the ejection port rows of a corresponding one of different colors.

The control circuit 4000 loads the received image data into the RAM 4002. Further, the control circuit 4000 controls driving of the recording head 5 via a recording head drive circuit 4006 based on the data on the RAM 4002, and also controls the carriage motor 4011 via a carriage motor drive circuit 4010. With this configuration, ink is ejected to a desired position on the recording medium P, and recording and scanning processing corresponding to one scan is executed. Then, the control circuit 4000 controls the paper feed motor 4013 via a paper feed motor drive circuit 4012, whereby the recording medium P is conveyed by a predetermined pitch.

Figure 5:
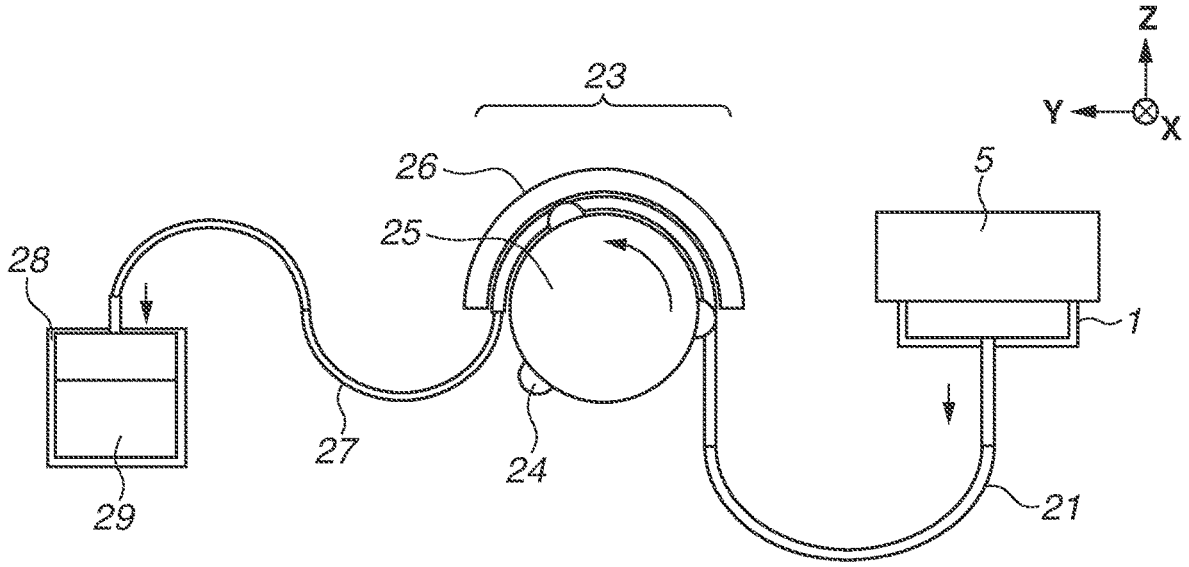
FIG. 5 is a schematic view illustrating a suction mechanism according to the exemplary embodiment.

FIG. 5 is a schematic view illustrating the suction mechanism according to the present exemplary embodiment. A suction pump 23 is driven in a state where the ejection ports formed on the ejection port surface 40 of the recording head 5 are covered with a cap 1, to suck ink from the ejection ports. In the suction pump 23, a shaft 25 on which rollers 24 are disposed is rotated in a direction indicated by an arrow, and a suction tube 21 corresponding to a portion held by the rollers 24 and a guide 26 is sequentially pressed and the rollers 24 are rotated. Consequently a depressurization occurs in the suction tube 21, and as a result, the recording head 5 is depressurized through the cap 1 and ink is sucked from the ejection ports. The amount of suction is controlled based on a prescribed number of rotations and a rotational speed of the rollers 24. Ink discharged from the suction pump 23 is contained in a waste ink tank 28 via a waste ink tube 27. A waste ink absorber 29 that absorbs waste ink is provided in the waste ink tank 28.

In the suction mechanism according to the present exemplary embodiment, since the cap 1 is not provided with an atmospheric air communication valve, the recording head 5 is scanned in the X-direction to communicate with atmospheric air to cause the recording head 5 to be spaced apart from the cap 1. The communication of the recording head 5 with atmospheric air when the cap 1 is removed from the recording head 5 causes an impact on ink droplets and the ink droplets likely adhere to the ejection port surface 40 of the recording head 5.

FIG. 6 is a perspective view illustrating the recovery mechanism unit 104 according to the present exemplary embodiment. The slider 7 is provided with a contacting portion 7*a* that is configured to come into contact with a side surface of the carriage 6, to move within the predetermined range by following the movement of the carriage 6. The slider 7 is biased in a negative X direction by a slider spring 17. This configuration enables the slider 7 to move from a retracting position where the wipers 8 and 9 and the caps 1A and 1B are apart from the recording head 5 to a wiping position where the ejection port surfaces 40*a* and 40*b* of the recording head 5 can be wiped with the wipers 8 and 9. The wiper 8 wipes the ejection port surface 40*a*. The wiper 9 wipes the ejection port surface 40*b*. The slider 7 can also be moved to a capping position where the ejection port surfaces 40*a* and 40*b* of the recording head 5 can be covered with the caps 1A and 1B, respectively. Four projecting portions 7*b* are provided on side surfaces of the slider 7 in the Y-direction intersecting with (orthogonal to in this case) the movement direction of the carriage 6.

While FIG. 6 illustrates only two projecting portions 7*b* that are provided in the negative Y-direction, the other two projecting portions 7*b* are provided in a positive Y-direction. Each of the four projecting portions 7*b* is in contact with a slider cam 13*a* provided on a main body bottom case 13. The slider 7 is moved while the four projecting portions 7*b* slide along a cam surface of the slider cam 13*a* provided on the main body bottom case 13. This sliding operation controls the slider 7 to be set at a predetermined height with respect to the ejection port surfaces 40*a* and 40*b* at each position (retracting position, wiping position, capping position, etc.) along the movement direction of the carriage 6.

The wiper 8 for wiping the ejection port surface 40*a* of the recording head 5*a* for special colors and the wiper 9 for wiping the ejection port surface 40*a* of the recording head 5*b* for CMY colors are attached to the slider 7. The caps 1A and 1B for capping the ejection port surfaces 40*a* and 40*b*, respectively, are attached to cap holders 2A and 2B, respectively. The cap holders 2A and 2B are each attached to the slider 7 with four claw portions. A cap spring is disposed between each of the cap holders 2A and 2B and the slider 7. The cap holders 2A and 2B to which the caps 1A and 1B are attached, respectively, are biased against the ejection port surfaces 40*a* and 40*b*, respectively, in a positive Z-direction. The wipers 8 and 9 and the caps 1A and 1B are disposed in the order of the wiper 8, the cap 1A, the wiper 9, and the cap 1B in the positive X-direction from a recording region.

As illustrated in FIG. 6, on the slider 7, a lock lever 16 serving as a locking member that operates to lock the slider 7 at the wiping position is attached to a portion on a downstream side (negative Y-direction side) in a conveyance direction at an end of the recording region side. The lock lever 16 is attached to be rotatably movable between a locking position at which the slider 7 is locked at the wiping position and a release position at which the locking state of the slider 7 is released. The lock lever 16 operates to regulate the movement of the slider 7 so that the slider 7 is prevented from moving in the negative X-direction and the negative Z-direction when the carriage 6 moves to the wiping position to wipe the ejection port surfaces 40*a* and 40*b* of the recording head 5. The lock lever 16 is supported to be rotatably movable within a plane in the Y-direction intersecting with (orthogonal to in this case) the movement direction of the carriage 6. The lock lever 16 has a support axis 16*e* and is supported to be rotatably movable about the support axis 16*e*. Further, a biasing force of a helical torsion coil spring (not illustrated) that causes the lock lever 16 to be rotated counterclockwise acts on the lock lever 16, to hold the lock lever 16 at a position where the lock lever 16 is moved by the spring biasing force, unless external torque of a predetermined value or more acts. The position where the lock lever 16 is moved by the spring biasing force corresponds to a position where a projecting portion 16*f* of the lock lever 16 comes into contact with the slider 7.

Figure 7A:
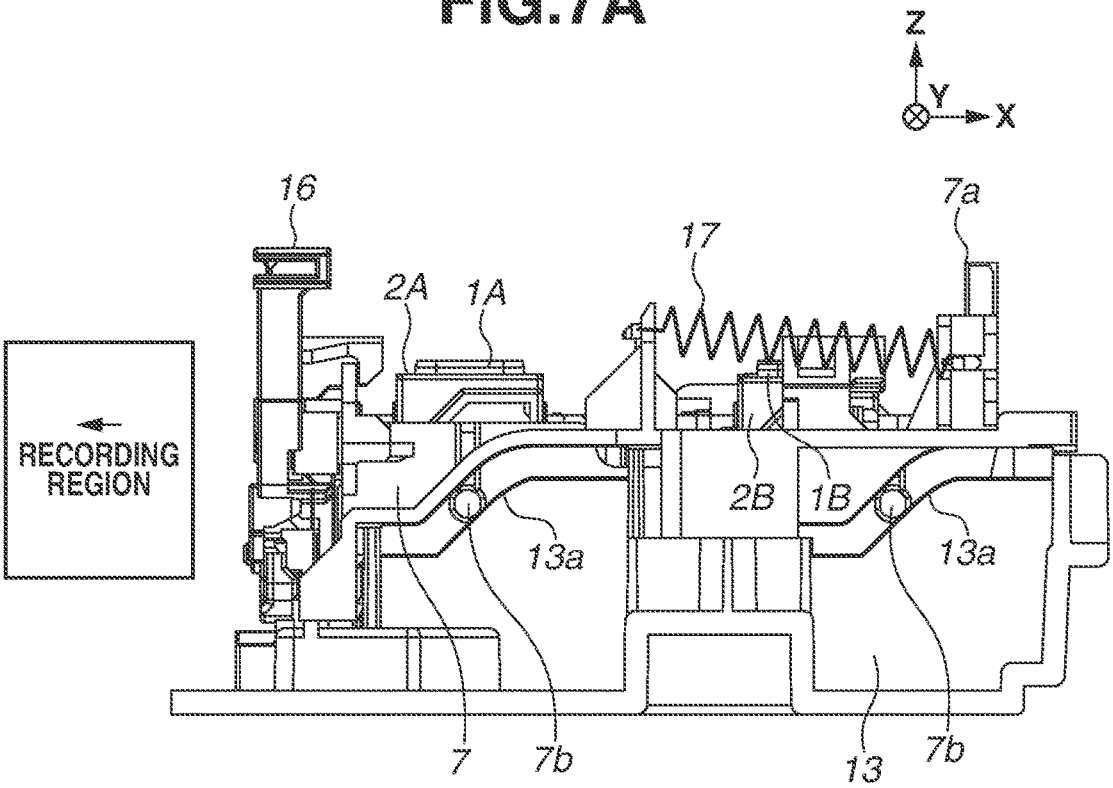
FIGS. 7A and 7B are front views each illustrating the recovery mechanism portion according to the present exemplary embodiment.
Figure 7B:
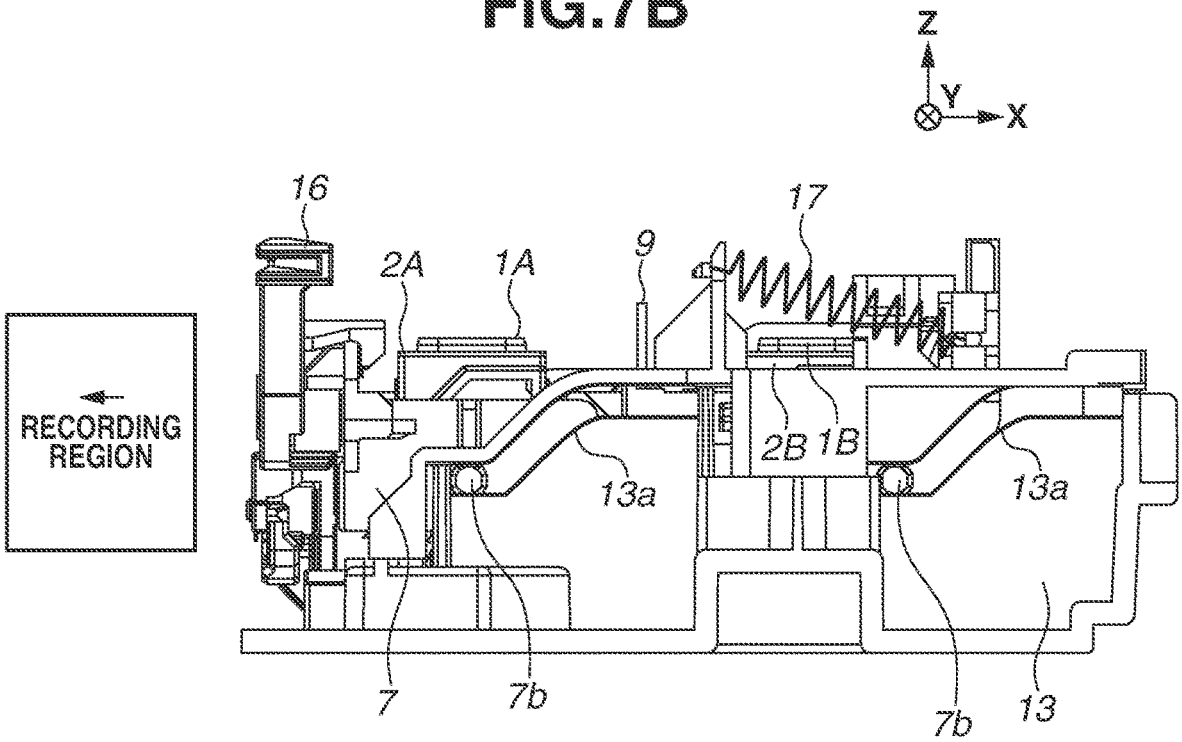

FIGS. 7A and 7B are front views each illustrating the recovery mechanism unit 104 in a state where the slider 7 is at different positions. The apparatus main body is provided with a locking portion 13*d* that is configured to lock a leading edge surface 16*a* of the lock lever 16 when the projecting portion 16*f* of the lock lever 16 and the slider 7 comes into contact with each other.

FIG. 7A illustrates a state of the recovery mechanism unit 104 during a wiping operation. First, the carriage 6 moves from the recording region in the positive X-direction and comes into contact with the contacting portion 7*a* to move the contacting portion 7*a* in the positive X-direction, whereby the wipers 8 and 9 are moved in the positive Z-direction. The leading edge surface 16*a* of the lock lever 16 is locked with the locking portion 13*d* at a position illustrated in FIG. 7A, and the position of each of the wipers 8 and 9 is fixed (this position is hereinafter referred to as a wipe trigger position). In this state, the carriage 6 moves toward the recording region, whereby the wiping operation is performed. The wipers 8 and 9 move relative to each other in the X-direction in a state where the wipers 8 and 9 are in contact with the ejection port surface 40, to wipe the ejection port surface 40. In the present exemplary embodiment, the carriage 6 moves to perform the wiping operation, but instead the wipers 8 and 9 may move to perform the wiping operation, or the carriage 6 and the wipers 8 and 9 may integrally move to perform the wiping operation.

During the wiping operation, the carriage 6 moves toward the recording region. The carriage 6 is provided with an unlocking projecting portion 67 (see FIG. 3) that is configured to come into contact with an upper end 16*b* of the lock lever 16. The unlocking projecting portion 67 comes into contact with the upper end 16*b* of the lock lever 16 when the carriage 6 moves toward the recording region, whereby the lock lever 16 can be rotationally moved clockwise as viewed from the recording region. As a result, the leading edge surface 16*a* of the lock lever 16 is separated from the locking portion 13*d*, and the locking state of the lock lever 16 is released as illustrated in FIG. 7B. Since the wipers 8 and 9 move in a negative Z-direction and the carriage 6 is not in contact with the recording head 5, the carriage 6 is movable toward the recording region and is ready for recording.

FIG. 8 is a table illustrating a list of carriage stop positions according to the present exemplary embodiment. As carriage (CR) stop positions for recovery, a cap close position, a wipe trigger position, a wiping preliminary ejection position, a cap open position, and a wipe trigger release position are set in order from a home position (positive X direction). At the CR stop positions illustrated in FIG. 8, the amount of driving of the carriage 6 from the cap close position, which is set as a reference position, is represented by the number of slits of a carriage encoder. When the carriage 6 is at the cap close position or the wipe trigger position, the caps 1A and 1B are in contact with the recording head 5. When the carriage 6 is at a position other than the cap close position or the wipe trigger position, the caps 1A and 1B are spaced apart from the recording head 5. Accordingly, since the carriage 6 is moved to the wipe trigger position when the wiping operation is performed, the caps 1A and 1B are configured to be in contact with the recording head 5. As stop positions for carriage height adjustment, a ready-to-ascend position, a descending position, an ascending position, and a ready-to-descent position are set in order from the home position.

FIGS. 9A to 9C are front views each illustrating the state of the cap 1A and the recording head 5*a* when the carriage 6 is at each stop position.

FIG. 9A illustrates a state where the carriage 6 is at the cap close position. In this state, the projecting portion 7*b* of the slider 7 is at a position closest to the home position in the slider cams 13*a*, and the cap 1A and the recording head 5*a* are in contact with each other. FIG. 9B illustrates a state where the carriage 6 is at the wipe trigger position. In this state, the projecting portion 7*b* of the slider 7 is at a position slightly closer to the home position than an inclined portion of the slider cam 13*a*, and the cap 1A and the recording head 5*a* are still in contact with each other. Lastly, FIG. 9C illustrates a state where the carriage 6 is at the wiping preliminary ejection position. In this state, the projecting portion 7*b* of the slider 7 is at the inclined portion of the slider cam 13*a*, and the cap 1A and the recording head 5*a* are spaced apart from each other.

Figure 10:
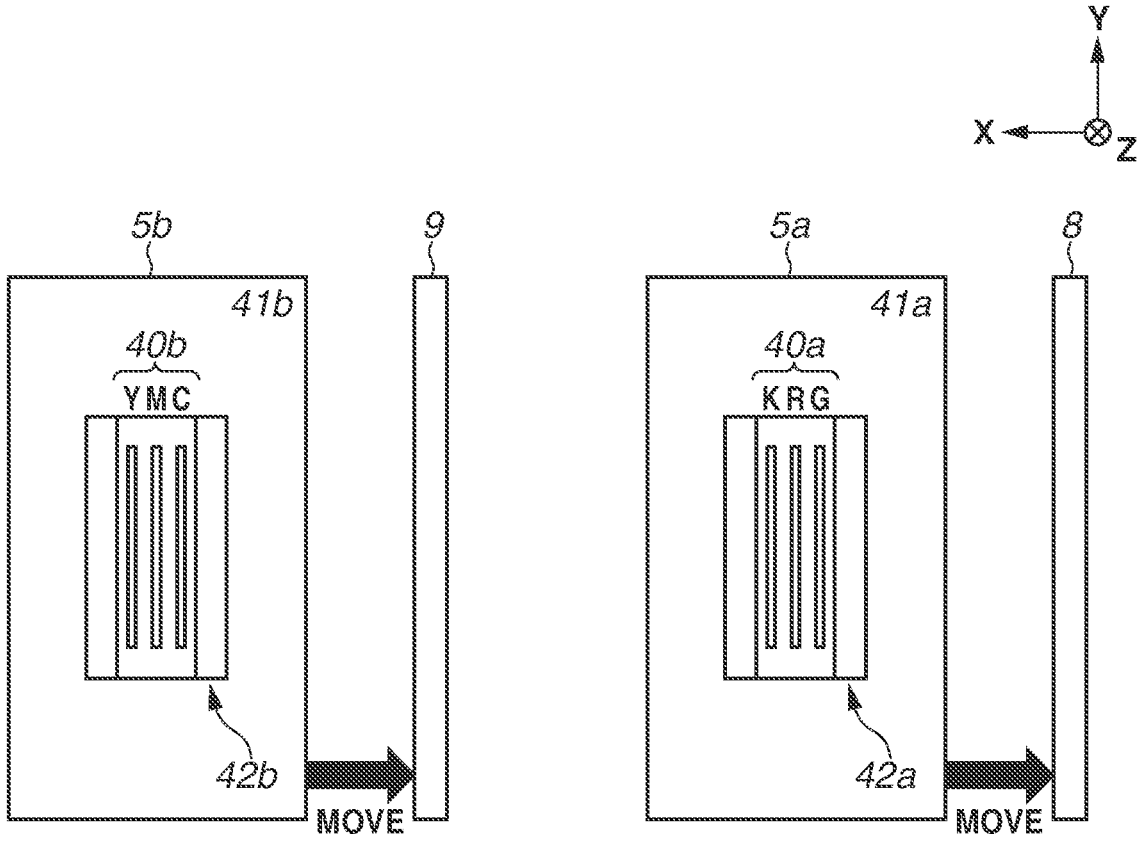
FIG. 10 is a schematic view illustrating a wiping method according to the exemplary embodiment.

FIG. 10 is a schematic view illustrating a wiping method using the wipers 8 and 9 on the recording head 5 according to the present exemplary embodiment. The recording head 5*a* for special colors is provided with the ejection port surface 40*a* on which ejection port rows for gray, red, and black ink, respectively, are formed. On the ejection port surface 40*a*, recessed portions 42*a* are provided on the ejection port surface side with the ejection ports interposed therebetween. A tab surface 41*a* is provided on the outside of the ejection port surface 40*a*. The recording head 5*a* is moved in a direction (X-direction) parallel to the ejection port surface 40 during carriage scanning, whereby the wiper 8 can wipe the ejection port surface 40*a*, the tab surface 41*a*, and the recessed portions 42*a*. Similarly, the recording head 5*b* for CMY colors includes a tab surface 41*b* and recessed portions 42*b*. The tab surfaces 41*a* and 41*b* are also referred to simply as a tab surface 41. The recessed portions 42*a* and 42*b* are also referred to simply as a recessed portion 42.

In suction recovery in the sequence according to the present exemplary embodiment, the control circuit 4000 controls the suction pump 23 via a suction pump drive circuit 4008, whereby a desired amount of ink is sucked by the recording head 5. A preliminary ejection for ejecting ink in the caps 1A and 1B is an operation for ejecting ink that does not contribute to image recording. The preliminary ejection is performed such that the control circuit 4000 controls driving of the recording head 5 via the recording head drive circuit 4006 to discharge the desired amount of ink. In this case, a pattern for driving the recording head 5 is determined based on any one of data loaded into the RAM 4002 like in the recording operation on the recording medium P, data stored in the ROM 4001, and data generated by the control circuit 4000.

The inkjet recording apparatus 100 performs a head recovery operation by suction recovery control for, for example, removing bubbles and discharging solidified ink from the recording head 5, and filling ink in the recording head 5. The recovery operation may be desirably performed in a situation where the cap 1 remains in the open state after abnormal termination, for example, when the operation of the inkjet recording apparatus 100 is stopped by pulling out a cord instead of pressing a power-off button. The recovery operation may be also desirably performed, for example, when a liquid container is replaced, after a lapse of a certain period from the previous recovery operation, or when the number of ink droplets (e.g., the number of dots) used for a recording operation from the previous recovery operation is more than or equal to a certain value. Under such situations, a recovery flag is set and stored in the nonvolatile memory 4004 illustrated in FIG. 4. The control circuit 4000 performs the recovery operation at a predetermined timing based on the recovery flag.

Figure 11:
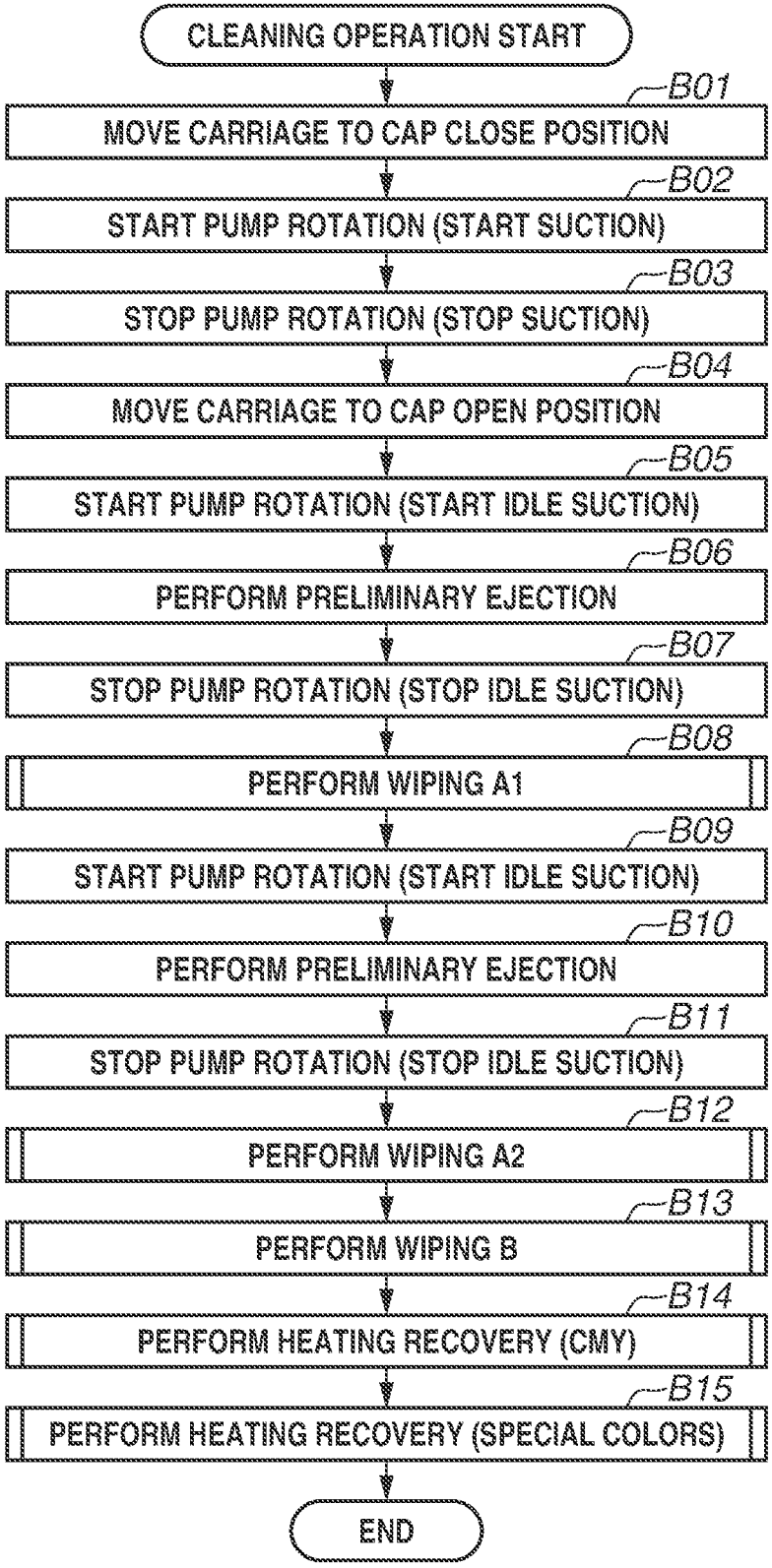
FIG. 11 is a flowchart illustrating a cleaning operation procedure according to the exemplary embodiment.

FIG. 11 is a flowchart illustrating a cleaning operation according to the present exemplary embodiment. The cleaning operation is performed when cleaning is instructed by a user, after a lapse of a certain period from the previous recovery operation, or when the number of ink droplets used for the recording operation after the previous recovery operation is more than or equal to a certain value. In addition, for example, the cleaning operation is performed when the cap 1 remains in the open state after abnormal termination, when the inkjet recording apparatus 100 is used for the first time, and when the recording head 5 is replaced with new one. The cleaning operation is executed such that the control circuit 4000 causes each mechanism to operate according to a control program stored in the ROM 4001 or a control program loaded into the RAM 4002.

First, in step B01, the carriage 6 is moved to the cap close position. As described above, when the carriage 6 is at the cap close position, the ejection port surfaces 40*a* and 40*b* of the recording head 5 are covered with the caps 1A and 1B, respectively.

After that, in step B02, driving of the suction pump 23 is started to start suction of ink from each ejection port. When the shaft 25 of the suction pump 23 is rotated by a predetermined number of times, in step B03, the rotation of the shaft 25 is stopped and the suction is finished. In step B04, the carriage 6 is moved to the cap close position to separate the caps 1A and 1B from the recording head 5, whereby an inside pressure of the recording head 5 is released to an atmospheric pressure.

Next, in step B05, the suction pump 23 is driven again. In step B06, the preliminary ejection in the caps 1A and 1B is performed. The suction operation in step B02 causes some types of ink in the ejection ports to be mixed. The preliminary ejection in step B06 is performed to remove the mixture of colors of ink. In step B05, the suction pump 23 is driven so that ink ejected in the cap 1 is sucked in step B06. Like in step B05, driving of the suction pump 23 in a state where the ejection port surface 40 of the recording head 5 is not covered with the cap 1 is hereinafter referred to as idle suction. After the shaft 25 of the suction pump 23 is rotated by the predetermined number of times, in step B07, driving of the suction pump 23 is stopped. After that, in step B08, wiping A1 is performed. Wiping A1 will be described in detail below.

Next, in steps B09, B10, and B11, the idle suction and preliminary ejection are performed. Steps B09 to B11 are similar to processes described above with reference to steps B05 to B07. After that, in step B12, wiping A2 is performed, and in step B13, wiping B is performed. To evaporate and reduce ink droplets remaining near the ejection port surface 40 after wiping B is finished, a heating recovery operation for the recording head 5*b* for CMY colors is performed in step B14 and a heating recovery operation for the recording head 5*a* for special colors is performed in step B15. Wiping A2 and wiping B will be described in detail below. The processes as described above are performed and then the cleaning operation is terminated.

Figure 12:
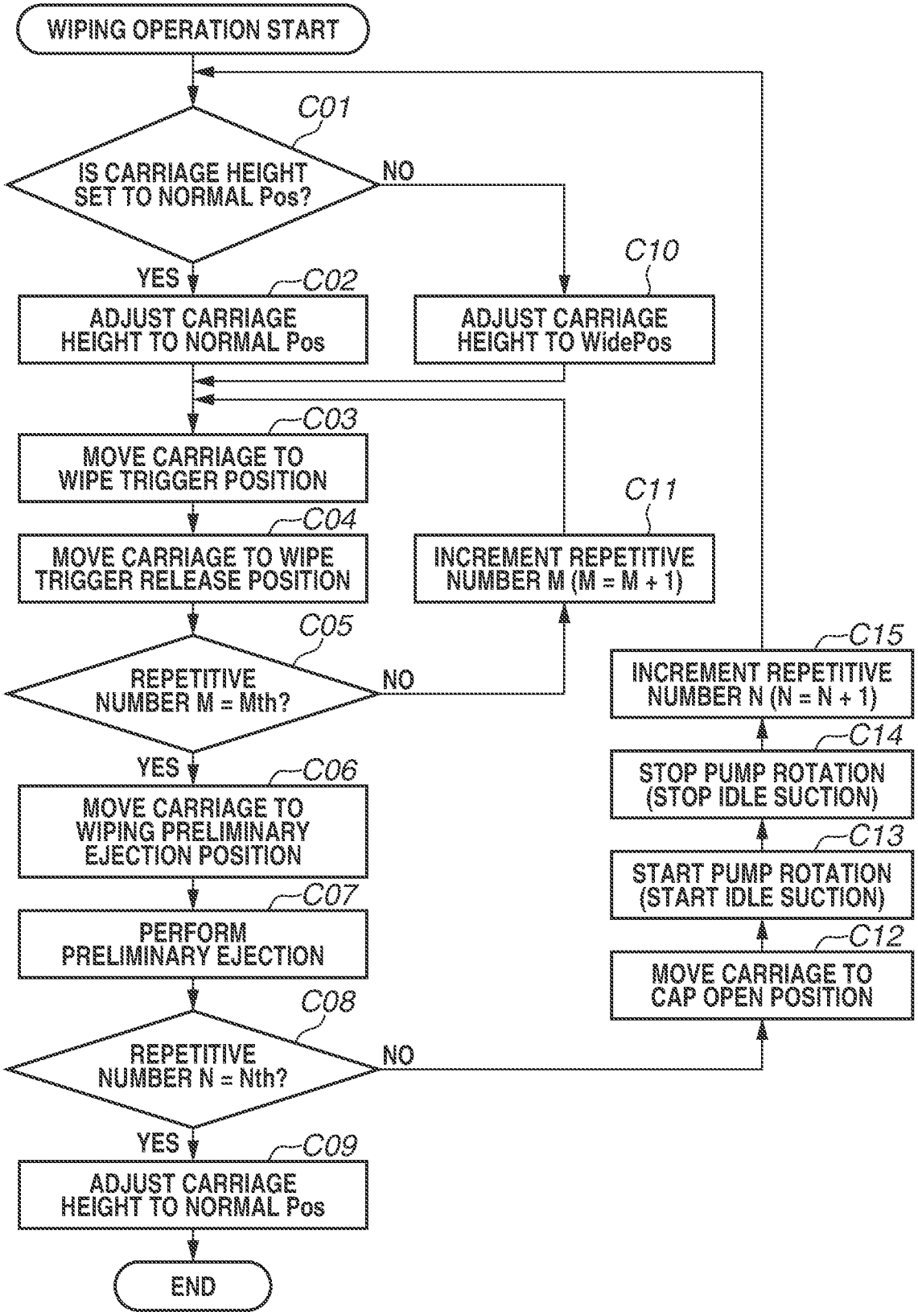
FIG. 12 is a flowchart illustrating a wiping operation procedure according to the exemplary embodiment.

FIG. 12 is a flowchart illustrating operations of wiping A1, wiping A2, and wiping B according to the present exemplary embodiment. In wiping A1, wiping A2, and wiping B, the wiping operation illustrated in FIG. 12 is performed under conditions illustrated in a table of FIG. 13. The conditions illustrated in FIG. 13 are written in the RAM 4002.

The wiping operation is performed, for example, during the cleaning operation illustrated in FIG. 11, after sheet discharge, or before the cap 1 is closed. The wiping operation is executed such that the control circuit 4000 causes each mechanism to operate according to a control program stored in the ROM 4001 or a control program loaded into the RAM 4002.

First, in step C01, a carriage height setting corresponding to a wiping condition for wiping in the wiping operation is obtained. In a case where a normal position (hereinafter referred to as "normal Pos") is designated at the wiping condition (wiping A1 and wiping A2 in this case) (YES in step C01), the processing proceeds to step C02. In step C02, the height of the carriage 6 is adjusted to the normal Pos. In a case where a position other than the normal Pos is designated (wiping B in this case) (NO in step C01), the processing proceeds to step C10. In step C10, the height of the carriage 6 is adjusted to a wide position (hereinafter referred to as "WidePos"). In a case where the height of the carriage 6 at the start of processing illustrated in FIG. 12 is the height corresponding to the condition obtained in step C01, the operations of steps C02 and C10 are omitted. By moving the carriage 6 in the height direction, the distance between the ejection port surface 40 and the slider 7 (installation unit) in the Z-direction when the ejection port surface 40 is wiped with the wipers 8 and 9 is determined.

After that, in step C03, the control circuit 4000 causes the carriage 6 to move to the wipe trigger position (see FIG. 9B). This movement brings the recording head 5 into contact with the cap 1, and the wipers 8 and 9 are moved in the positive Z-direction and the height of each of the wipers 8 and 9 is fixed.

Next, in step C04, the control circuit 4000 causes the carriage 6 to move to the wipe trigger release position. The movement in the positive X-direction causes the cap 1 to be separated from the recording head 5, and the wipers 8 and 9 wipe the ejection port surface 40 and the tab surface 41*a* of the recording head 5. After that, in step C05, it is determined whether the number of wiping operations (repetitive number) M has reached a predetermined number Mth that is set as a wiping condition. In a case where it is determined that the repetitive number M has not reached the predetermined number Mth (NO in step C05), the processing proceeds to step C11. In step C11, the repetitive number M is incremented, and then the processing returns to step C03. In a case where it is determined that the repetitive number M has reached the predetermined number Mth (YES in step C05), the processing proceeds to step C06. In step C06, the carriage 6 is moved to the wiping preliminary ejection position (see FIG. 9C). In step C07, the preliminary ejection for ejecting ink in the cap 1 is performed. After that, in step C08, it is determined whether the repetitive number N has reached a predetermined number Nth that is set as a wiping condition. In a case where the repetitive number N has not reached the predetermined number Nth (NO in step C08), the processing proceeds to step C12. In step C12, the carriage 6 is moved to the cap open position. After that, in steps C13 and C14, the idle suction is performed. In step C15, the repetitive number N is incremented, and then the processing returns to step COL In step C08, in a case where the repetitive number N has reached the predetermined number Nth (YES in step C08), the processing proceeds to step C09. In step C09, the position of the carriage 6 in the Z-direction is changed to the normal Pos.

FIG. 13 is a table illustrating wiping conditions according to the present exemplary embodiment. In wiping A1 (wiping immediately after suction), the carriage height is set to the normal Pos, a wiper intrusion amount is set to 1.5 mm, a wiping speed is set to 110 mm/s, the repetitive number M is set to "1", and the repetitive number N is set to "1". Next, in wiping A2, the carriage height, the wiper intrusion amount, and the wiping speed are the same as those in wiping A1, but the repetitive number M is set to a plurality of number of times ("4") and the repetitive number N is set to "1". Lastly, in wiping B, the wiper intrusion amount and the wiping speed are the same as those in wiping A1, but the carriage height is set to WidePos, the wiper intrusion amount is set to 0.7 mm, the repetitive number M is set to "4", and the repetitive number N is set to a plurality of number of times ("3"). Thus, in the present exemplary embodiment, after the suction, wiping (wiping A2) in which the intrusion amount is large is performed and then wiping (wiping B) in which the intrusion amount is small is performed. The number of wiping operations in which the intrusion amount is small is set to be larger than the number of wiping operations in which the intrusion amount is large. The reasons for this will be described below.

Figure 14:
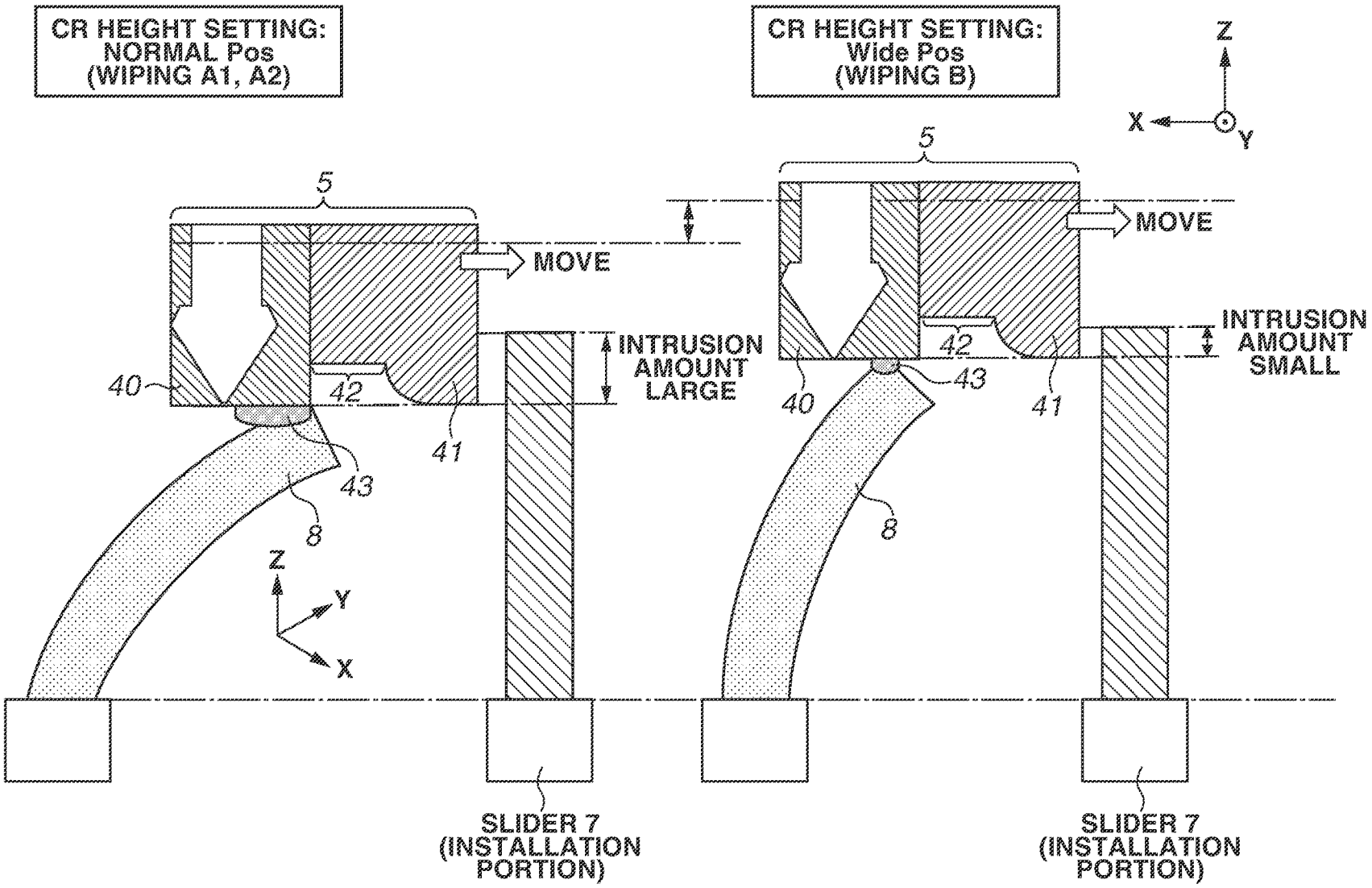
FIG. 14 is a schematic view illustrating a state of the wiper with respect to an ejection port row during the wiping operation according to the exemplary embodiment.

FIG. 14 is a schematic view illustrating a state of the wiper 8 with respect to the ejection port row during the operations of wiping A1 and wiping A2 and during the operation of wiping B according to the present exemplary embodiment. The carriage height in wiping B is set to be higher than that in wiping A1 and wiping A2. In other words, the distance in the Z-direction between the ejection port surfaces 40*a* and 40*b* and the wiper installation unit of the slider 7 when the operations of wiping A1 and A2 are performed is larger than that when the operation of wiping B is performed. Accordingly, the wiper intrusion amount (length of the wiper on the positive Z-direction side that is perpendicular to the ejection port surface and is opposite to the direction in which liquid is ejected with respect to the ejection port surface) with respect to the recording head 5 in wiping B is smaller than that in wiping A1 and wiping A2, and a contact pressure in wiping B is lower than that in wiping A1 and wiping A2. In wiping B in which the intrusion amount and the contact pressure are smaller, the contact area of the wiper is smaller than that in wiping A1 and wiping A2. Accordingly, the removability of ink droplets adhering to the ejection port surfaces 40*a* and 40*b* and the tab surfaces 41*a* and 41*b* in wiping B is lower than that in wiping A1 and wiping A2. An ink droplet 43 in FIG. 14 is a droplet of ink removed from the ejection port surface 40*a* and the tab surface 41*a* or the ejection port surface 40*b* and the tab surface 41*b* by the wiping.

Figure 15:
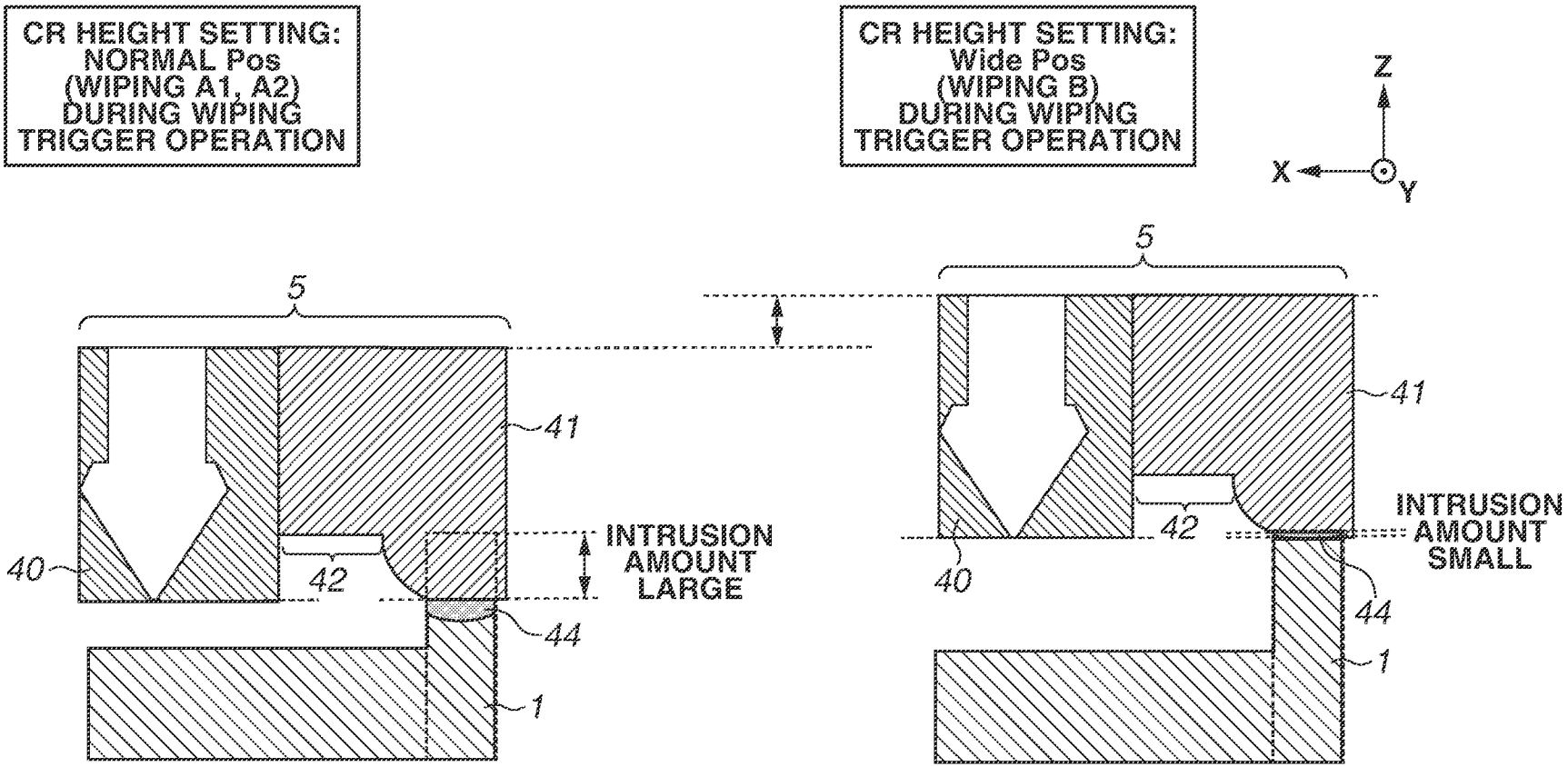
FIG. 15 is a schematic view illustrating a contact state of a cap with respect to the recording head during a wiping trigger operation according to the exemplary embodiment.

FIG. 15 is a schematic view illustrating a contact state of the cap 1 with respect to the recording head 5 during the operations of wiping A1 and wiping A2 according to the present exemplary embodiment and during the trigger operation (step C03 illustrated in FIG. 12) in which the carriage 6 is moved to the wiping trigger position during the operation of wiping B. In the trigger operation in wiping B, the height of the recording head 5 is higher than that in the trigger operation in wiping A1 and wiping A2, and thus the intrusion amount of the cap 1 with respect to the recording head 5 is small. Therefore, the amount of ink 44 to be transferred onto the tab surface 41*a* from the cap 1 in the trigger operation in wiping B is smaller than that in the trigger operation in wiping A1 and wiping A2.

Figure 16:
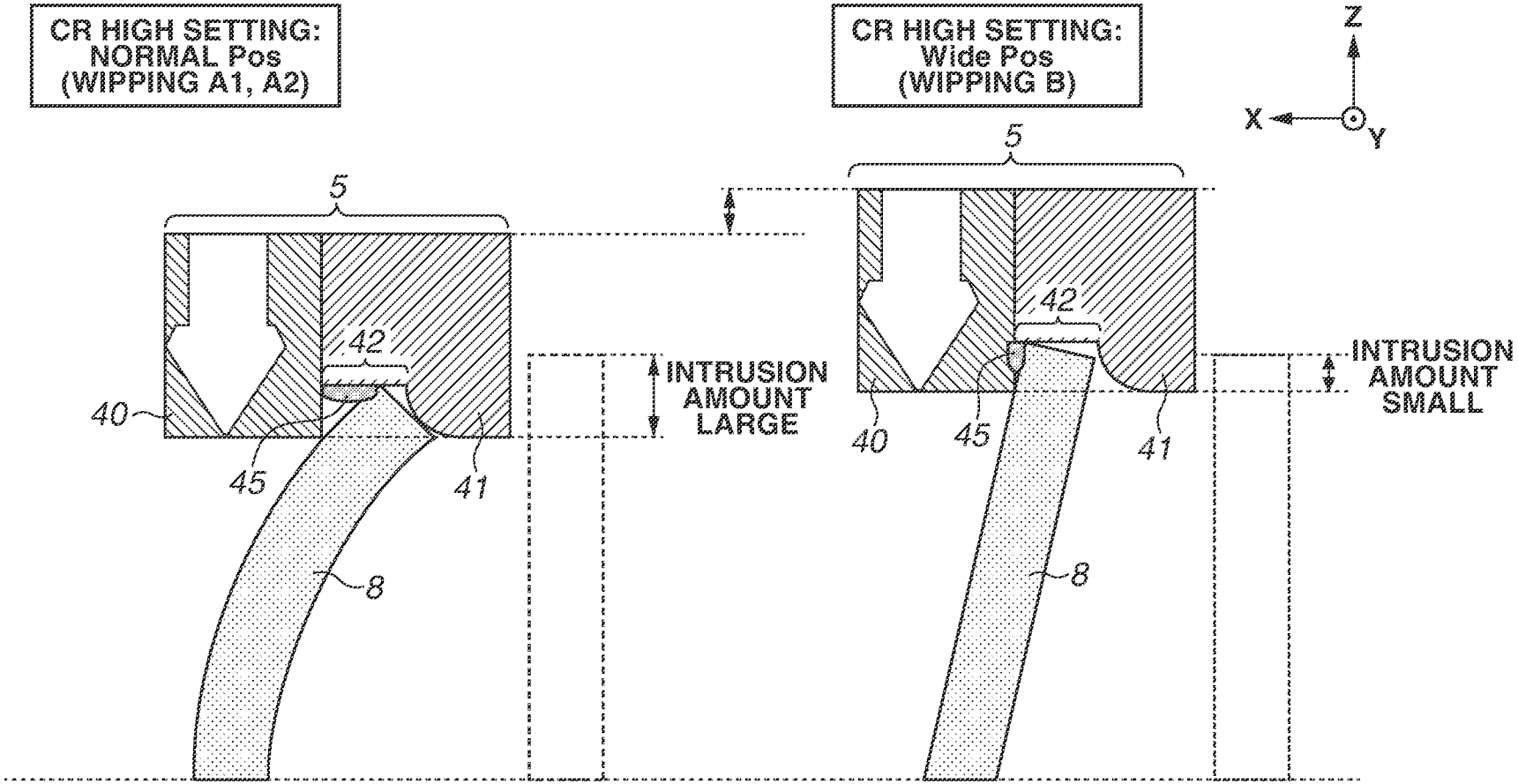
FIG. 16 is a schematic view illustrating a contact state of the wiper with respect to a recessed portion during the wiping operation according to the exemplary embodiment.

FIG. 16 is a schematic view illustrating a contact state of the wiper 8 with respect to the recessed portion 42 during the wiping operation according to the present exemplary embodiment. The height of the carriage 6 in wiping B is set to a position higher than that in wiping A1 and wiping A2. Accordingly, the intrusion amount of the wiper 8 with respect to the recessed portion 42 in wiping B is smaller than that in wiping A1 and wiping A2. In wiping B, when the wiper 8 is below the recessed portion 42, the wiper 8 more perpendicularly enters the recessed portion 42 than in wiping A1 and wiping A2, so that the area of the region where the wiper 8 is in contact with ink droplets in the recessed portion 42 is increased and ink droplet 45 in the recessed portion 42 can be easily removed.

FIG. 17 is a table illustrating recovery performances in wiping A1, wiping A2, and wiping B according to the present exemplary embodiment. Ink droplets on the ejection port surface 40 and the tab surface 41 can be hardly removed in wiping B, unlike in wiping A1 and wiping A2. However, the amount of ink to be transferred in the trigger operation is smaller and thus ink droplets in the recessed portion 42 can be easily removed.

Advantageous effects of the present exemplary embodiment will be described with reference to FIGS. 18 and 19.

Figure 18:
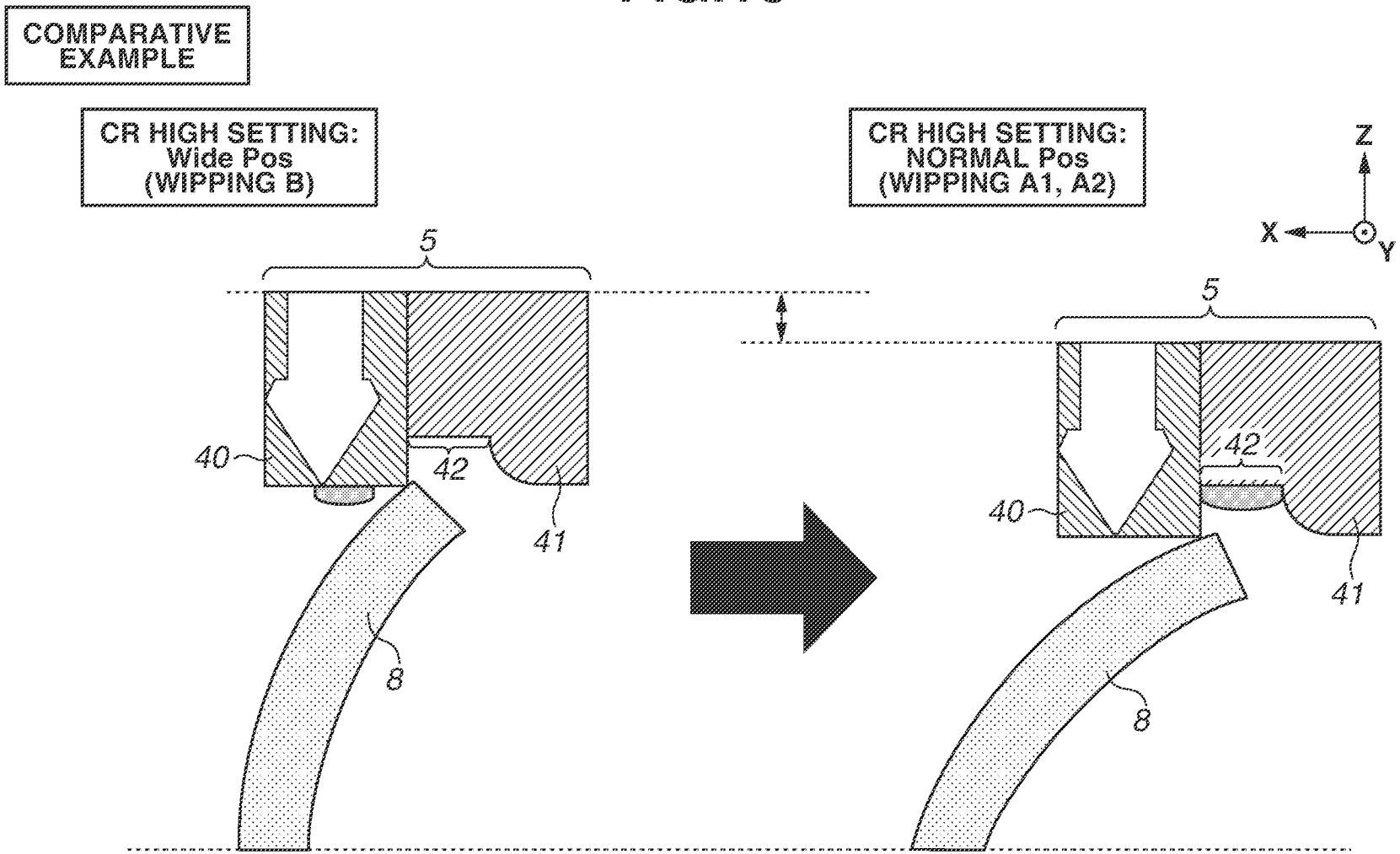
FIG. 18 is a schematic view illustrating a state of a recessed portion according to a comparative example.

FIG. 18 is a schematic view illustrating a state of the recessed portion when wiping A1 and wiping A2 in which the intrusion amount is large are performed after wiping B in which the intrusion amount is small is performed as a comparative example. If wiping B is performed first, ink droplets in the recessed portion 42 can be removed. However, the cap 1 is brought into firm contact with the tab surface 41 and ink droplets are transferred onto the tab surface 41 in the subsequent trigger operation in wiping A1 and wiping A2, and consequently the ink droplets are supplied to the recessed portion 42 again in the subsequent wiping operation. If the cleaning operation is finished in this state, ink is drawn out of the recessed portion 42 at a timing when the subsequent wiping operation is performed (e.g., in a cap closing operation after printing) and the ink droplets remain on the ejection ports. This causes an ejection failure in which, for example, the ejection operation cannot be performed on the ejection ports, the amount of ink to be ejected is small, or ink is not ejected straight in the ejection operation.

Figure 19:
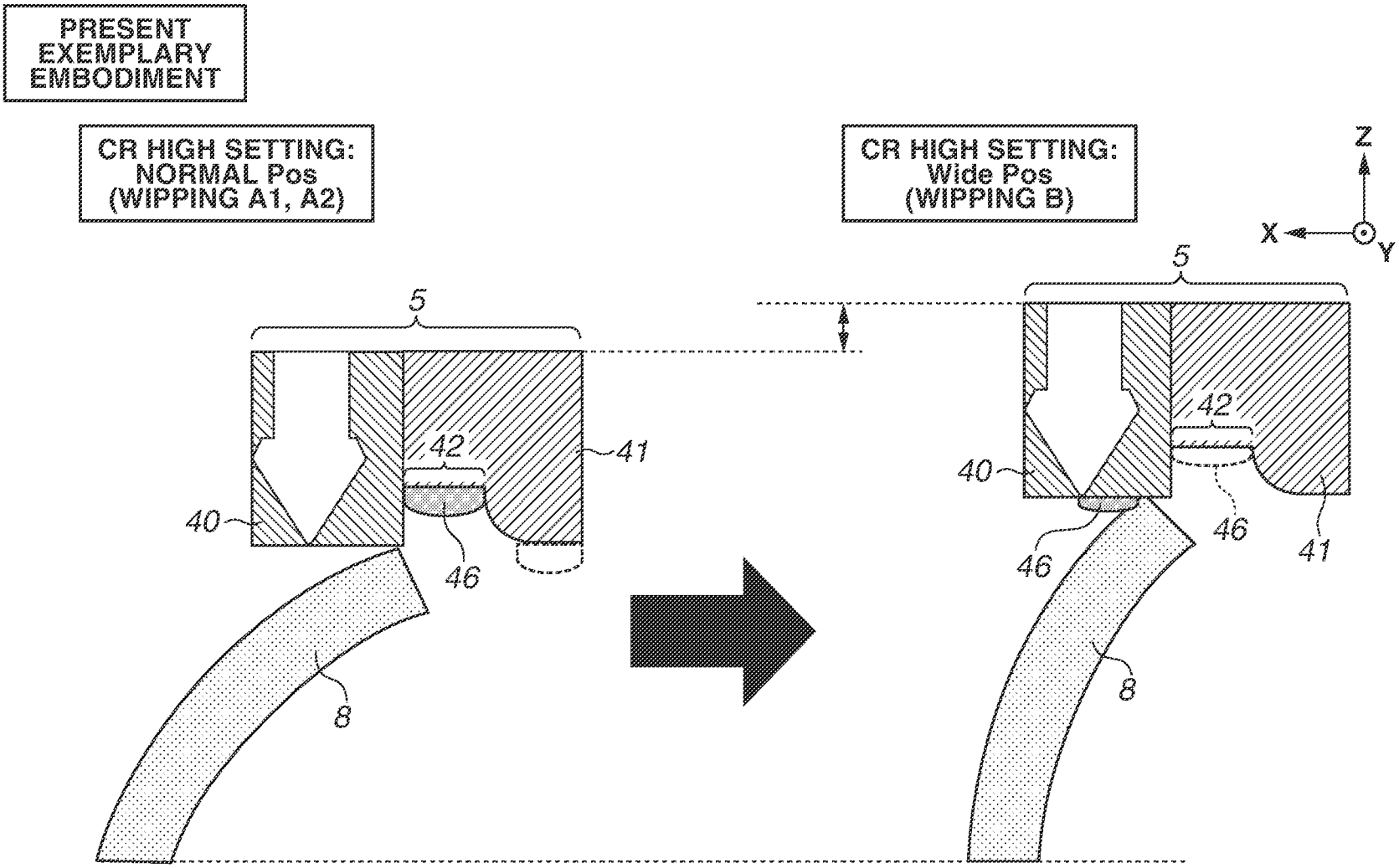
FIG. 19 is a schematic view illustrating a state of the recessed portion according to the exemplary embodiment.

FIG. 19 is a schematic view illustrating a state of the recessed portion 42 when wiping A1 and wiping A2 in which the intrusion amount is large are performed and then wiping B in which the intrusion amount is small is performed according to the present exemplary embodiment. If wiping A1 and wiping A2 are performed first, the cap 1 is brought into firm contact with the tab surface 41 by the trigger operation, and consequently, ink 46 is accumulated in the recessed portion 42 in the subsequent wiping operation. However, in the subsequent trigger operation in wiping B, the cap intrusion amount with respect to the recording head 5 is reduced, whereby the amount of ink to be transferred onto the tab surface 41 can be reduced and the ink 46 remaining in the recessed portion 42 can be scraped off by the subsequent wiping operation. If the cleaning operation is finished in this state, the number of ejection ports in which the ejection failure occurs can be reduced since the ink cannot be drawn out of the recessed portion 42 or the amount of ink to be drawn out is reduced, even at a timing when the subsequent wiping operation is performed (e.g., in the cap closing operation after printing).

In the cleaning operation according to the present exemplary embodiment, since the wiping operation in which the intrusion amount is small is performed after the wiping operation in which the intrusion amount is large is performed, a larger number of ink droplets are likely to finally remain on the ejection port surface 40 than when the wiping operation in which the intrusion amount is large is performed last. For this reason, the heating recovery operation is performed after the wiping operation to evaporate and reduce ink droplets on the ejection port surface 40, whereby the occurrence of the ejection failure can be prevented in the ejection ports after the cleaning operation. Further, the repetitive number of wiping operations in which the intrusion amount is small in the cleaning operation is set to be larger than the repetitive number of wiping operations in which the intrusion amount is large, whereby the number of ink droplets that finally remain on the ejection port surface 40 can be reduced and the number of ejection ports in which the ejection failure occurs after the cleaning operation can be further reduced.

Figure 20:
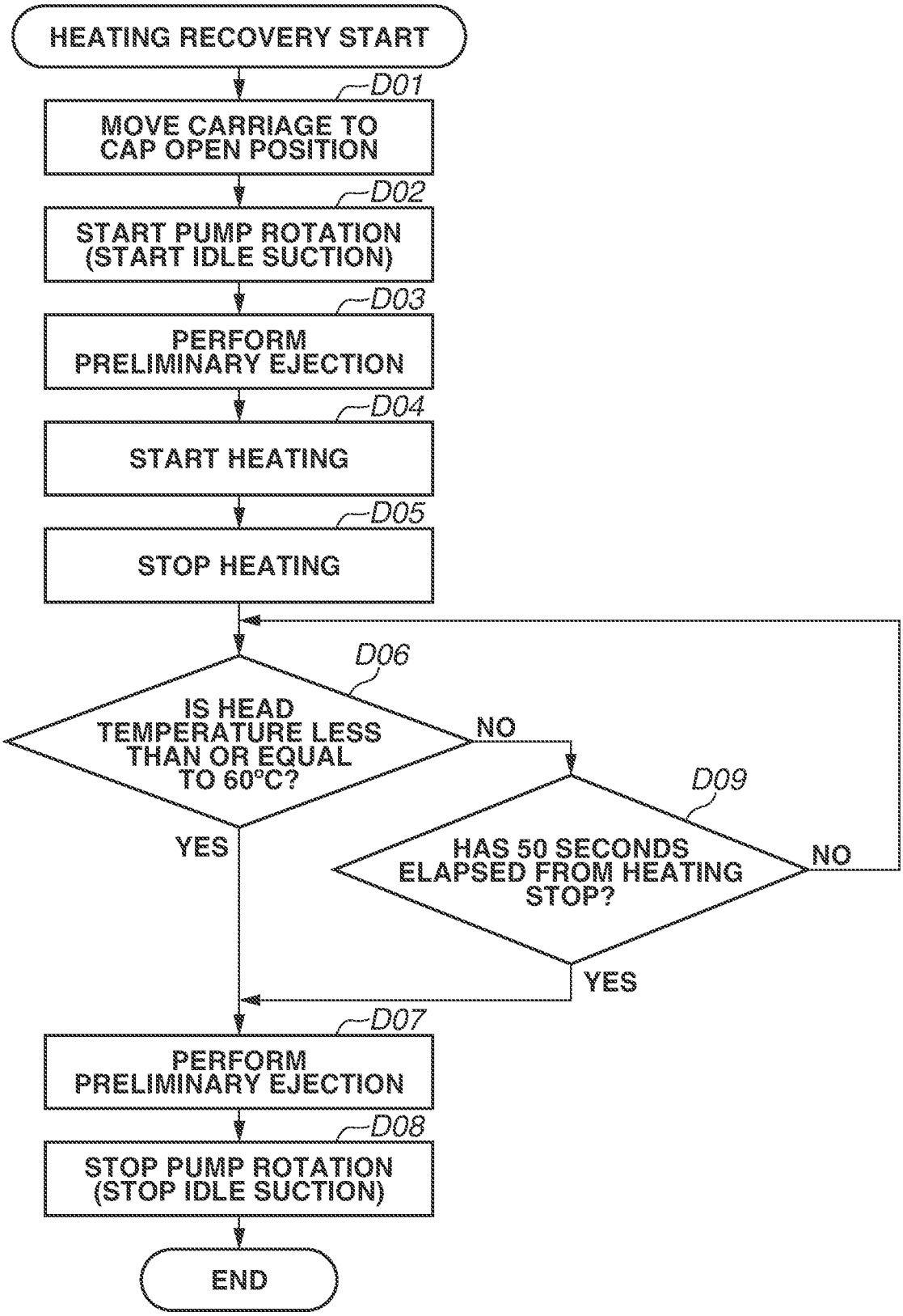
FIG. 20 is a flowchart illustrating a heating recovery operation procedure according to the exemplary embodiment.

FIG. 20 is a flowchart illustrating the heating recovery operation in step B014 in the cleaning operation illustrated in FIG. 11. While step B014 is described as the heating recovery operation for the recording head 5*b* for CMY colors in the present exemplary embodiment, a similar operation is performed also in the heating recovery operation of step B015 for the recording head 5*a* for special colors.

First, in step D01, the carriage 6 is moved to the cap open position. In step D02, driving of the suction pump 23 is started. Next, in step D03, the preliminary ejection in the cap 1B is performed. In step D04, heating of the ejection port surface 40 of the recording head 5 to a target temperature 80° C. is started. Heating of the ejection port surface 40 is performed by driving recording elements at such a level that ink is not ejected from the ejection ports. Additionally, if a heating element configured to heat the ejection port surface 40 is included, heating can be performed using the heating element. In step D05, heating is stopped when the temperature has reached the target temperature.

After that, in step D06, it is determined whether the head temperature is less than or equal to 60° C. In a case where the head temperature exceeds 60° C. (NO in step D06), the processing proceeds to step D09. In step D09, it is determined whether 50 seconds or more have elapsed from the heating stop. In a case where 50 seconds have not elapsed (NO in step D06), the processing returns to step D06. In a case where the head temperature is less than or equal to 60° C. in step D06 (YES in step D06), or in a case where 50 seconds or more has elapsed from the heating stop in step D09 (YES in step D09), the processing proceeds to step D07. In step D07, the preliminary ejection in the cap 1B is performed. In step D08, driving of the suction pump 23 is stopped. The heating recovery operation is completed as described above. The heating recovery operation is performed in the manner as described above, whereby the number of ejection ports in which the ejection failure occurs after the cleaning operation can be reduced by evaporating and reducing ink droplets near the ejection port surface 40 that have not been wiped in wiping B.

When the wiping operations (wiping A1 and wiping A2) in which the intrusion amount is large are performed after the heating recovery operation, the cap 1 is brought into firm contact with the recording head 5, and consequently ink droplets are transferred and ink is accumulated in the recessed portion 42 in the subsequent wiping operation. Further, when the wiping operation (wiping B) in which the intrusion amount is small is performed after the heating recovery operation, ink droplets scraped off from the recessed portion 42 in the wiping operation remain on the ejection port surface 40, which causes the ejection failure. Accordingly, in the cleaning operation according to the present exemplary embodiment, no wiping operations are performed after the heating recovery operation.

Figure 21:
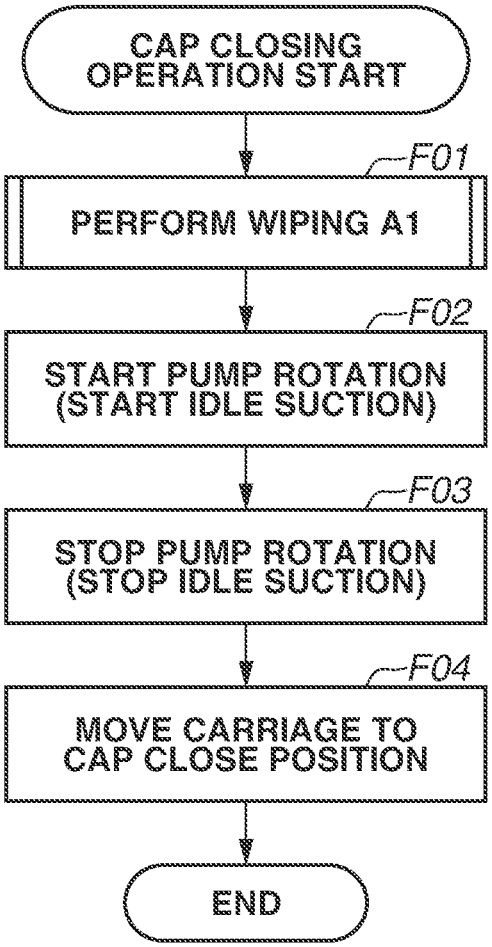
FIG. 21 is a flowchart illustrating a cap closing operation according to the exemplary embodiment.

FIG. 21 is a flowchart illustrating the cap closing operation according to the present exemplary embodiment. The cap closing operation is performed at a timing after a lapse of a predetermined period from the end of printing. This operation is executed such that the control circuit 4000 causes each mechanism to operate according to a control program stored in the ROM 4001 or a control program loaded into the RAM 4002.

First, in step F01, wiping A1 is performed. Next, in step F02, the suction pump 23 is driven to start the idle suction. After the suction pump 23 is rotated by a predetermined number of rotations, driving of the suction pump 23 is stopped and the idle suction is stopped in step F03. This idle suction is performed to discharge ink remaining in the cap 1, the suction tube 21, and the waste ink tube 27, to prevent solidification of ink in a discharge path. Lastly, in step F04, the carriage 6 is moved to the cap close position and then the operation is terminated.

In the wiping operation in the cap closing operation according to the present exemplary embodiment, the carriage height is set to the normal Pos. Accordingly, if ink droplets remain in the recessed portion 42, the ink droplets are drawn out of the ejection port surface 40 in the wiping operation, which causes the ejection failure. However, since the ink droplets in the recessed portion 42 are removed in the cleaning operation, the ink droplets are not drawn out in the wiping operation in the cap closing operation, whereby the ejection failure can be prevented from occurring after the cap closing operation.

As described above, the wiping operation in which the intrusion amount is small is performed after the wiping operation in which the intrusion amount is large is performed, whereby the number of ejection ports in which the ejection failure occurs after the wiping operation on the ejection port surface 40 can be reduced.

In the above-described exemplary embodiments, the recessed portions 42 are formed on both sides of the ejection ports in the main scanning direction (X-direction) and the wipers 8 and 9 and the carriage 6 move relative to each other in the X-direction to perform the wiping operation. However, the present disclosure is not limited to this configuration. For example, the recessed portions 42 may be formed on both sides of the ejection ports in the sub-scanning direction (Y-direction) and the wipers 8 and 9 and the carriage 6 may move relative to each other in the Y-direction to perform the wiping operation.

In the above-described exemplary embodiments, the slider 7 on which the wipers 8 and 9 are installed is moved to change the wiper intrusion amount. Alternatively, a configuration for changing the length of each of the wipers 8 and 9 extending in the positive Z-direction from the slider 7 may be used. More alternatively, the wiper intrusion amount may be changed by changing the length of each of the wipers 8 and 9 extending from the slider 7, without changing the distance between the ejection port surface 40 and the slider 7 in the Z-direction.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)?), a flash memory device, a memory card, and the like.

According to an aspect of the present disclosure, it is possible to prevent occurrence of an ejection failure after a wiping operation, while an ejection port surface is fully cleaned.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2021-019162, filed Feb. 9, 2021, which is hereby incorporated by reference herein in its entirety.

What is claimed is:

1. An ejection apparatus comprising:

an ejection head including an ejection port surface on which an ejection port configured to eject liquid is disposed, and a recessed portion that is formed at a position different from the ejection port surface on an ejection port surface side and is recessed further than at least the ejection port surface;

a wiper configured to wipe the ejection port surface;

an installation unit on which the wiper is installed; and a moving unit configured to cause the wiper and the ejection head to move relative to each other, by moving at least one of the wiper and the ejection head, to cause the wiper to move in a first direction along the ejection port surface with respect to the ejection head, wherein the wiper performs a wiping operation, for wiping the ejection head, to wipe the ejection port after wiping the recessed portion, and wherein in the wiping operation, a first wiping operation is performed in a state where the ejection port surface and the installation unit are at a first distance in a direction perpendicular to the ejection port surface, and then a second wiping operation is performed in a state where the ejection port surface and the installation unit are at a second distance in the direction perpendicular to the ejection port surface, the second distance being greater than the first distance.

2. The ejection apparatus according to claim 1, further comprising:

a cap configured to cover the ejection port surface, wherein the moving unit moves the cap and the ejection head relative to each other to a position where the cap covers the ejection port surface, and wherein the first wiping operation and the second wiping operation are performed after the cap covers the ejection port surface.

3. The ejection apparatus according to claim 1, further comprising:

a heating unit configured to heat the ejection head, wherein the heating unit performs heating after the second wiping operation.

4. The ejection apparatus according to claim 3, further comprising:

a detection unit configured to detect a temperature near the ejection port, wherein after the second wiping operation, the heating unit performs heating until the temperature detected by the detection unit reaches a first temperature and the heating unit stops heating when the temperature has reached the first temperature, and liquid that does not contribute to recording is ejected from the ejection port of the ejection head when the temperature detected by the detection unit has reached a second temperature lower than the first temperature, or after a lapse of a predetermined period from a time when the heating unit stops heating.

5. The ejection apparatus according to claim 1, wherein the first wiping operation is performed a first number of times and the second wiping operation is performed a second number of times, and wherein the second number of times is greater than one.

6. The ejection apparatus according to claim 5, wherein the second number of times is more than the first number of times.

7. The ejection apparatus according to claim 1, wherein the ejection port is configured to eject ink, and wherein the ejection head includes an ejection port row including a plurality of the ejection ports arranged in a direction intersecting with the first direction.

8. The ejection apparatus according to claim 7, wherein the ejection head includes a plurality of the ejection port rows, and wherein the ejection port rows includes a first ejection port row is configured to eject ink of a first color, and a second ejection port row is configured to eject ink of a color different from the first color, the first ejection port row and the second ejection row are arranged in the first direction.

9. The ejection apparatus according to claim 1, further comprising:

a plurality of the ejection heads and a plurality of the wipers, wherein each of the plurality of ejection heads is provided with a different one of the plurality of wipers.

10. The ejection apparatus according to claim 2, wherein the cap is not provided with an atmospheric air communication valve.

11. The ejection apparatus according to claim 1, further comprising a change unit configured to change a length of the wiper extending in the second direction with respect to the ejection port surface.

12. The ejection apparatus according to claim 1, wherein the moving unit moves at least one of the wiper and the ejection head such that a relative movement speed of the wiper and the ejection head in the first wiping operation matches a relative movement speed of the wiper and the ejection head in the second wiping operation.

13. The ejection apparatus according to claim 1, wherein during the first wiping operation and the second wiping operation, a length of the wiper extending from the installation unit to the ejection port surface in the direction perpendicular to the ejection port surface is constant.

14. An ejection apparatus comprising:

an ejection head including an ejection port configured to eject liquid disposed on an ejection port surface of an ejecting side of the ejection head, and a recessed portion disposed on the ejecting side and that is formed at a position different from the ejection port surface, on an ejection port surface side of the ejection head, and is recessed further than at least the ejection port surface;

a wiper configured to wipe the ejection port surface;

an installation unit on which the wiper is installed; and a moving unit configured to move the blade and the ejection head relative to each other by moving at least one of the wiper and the ejection head, so as to cause the wiper to move in a first direction along the ejection port surface with respect to the ejection head, wherein the wiper performs a wiping operation of the ejection head so as to wipe the ejection port after wiping the recessed portion, wherein in the wiping operation, in a case where the ejection head and the wiper are at a distance in the first direction, a first wiping operation is performed in a state where a portion corresponding to a first length of the wiper from a leading edge of the wiper is on a side in a second direction which is perpendicular to the ejection port surface and is opposite to a direction in which liquid is ejected further than the ejection port surface, and wherein in the wiping operation, after the first wiping operation, a second wiping operation is performed in a state where a portion corresponding to a second length of the wiper from the leading edge of the wiper is on the side in the second direction further than the ejection port surface in a case where the ejection head and the wiper are at a distance in the first direction, the second length being shorter than the first length.

15. The ejection apparatus according to claim 14, wherein the first wiping operation is performed a first number of times and then the second wiping operation is performed a second number of times, and wherein the second number of times is more than the first number of times.

16. A wiping method comprising:

ejecting ink from an ejection head including an ejection port surface on which an ejection port configured to eject ink is disposed, and a recessed portion that is formed at a position different from the ejection port surface on an ejection port surface side and is recessed further than at least the ejection port surface; and wiping the ejection head with a wiper to wipe the ejection port surface after wiping the recessed portion, wherein in the wiping, the ejection head is wiped such that the wiper wipes the ejection port surface to wipe the ejection port after wiping the recessed portion, the ejection head is wiped in a state where the ejection port surface and an installation unit on which the wiper is installed are at a first distance in a direction perpendicular to the ejection port surface, and then the ejection head is wiped in a state where the ejection port surface and the installation unit on which the wiper is installed are at a second distance larger than the first distance in the direction perpendicular to the ejection port surface.

17. The wiping method according to claim 16, further comprising:

performing capping to cover the ejection port surface with a cap, wherein the wiping is performed after the capping.

* * * * *